US008554115B2

(12) United States Patent
Hayashi et al.

(10) Patent No.: US 8,554,115 B2
(45) Date of Patent: Oct. 8, 2013

(54) DEVELOPING DEVICE, IMAGE FORMING APPARATUS, DEVELOPER AGITATING AND CONVEYING METHOD

(75) Inventors: Shigeki Hayashi, Osaka (JP); Takafumi Nagai, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 156 days.

(21) Appl. No.: 13/310,989

(22) Filed: Dec. 5, 2011

(65) Prior Publication Data

US 2012/0163872 A1 Jun. 28, 2012

(30) Foreign Application Priority Data

Dec. 28, 2010 (JP) ..... P2010-294280

(51) Int. Cl.
*G03G 15/08* (2006.01)

(52) U.S. Cl.
USPC ..... 399/256; 399/119

(58) Field of Classification Search
USPC ..... 399/254, 256
See application file for complete search history.

(56) References Cited

U.S. PATENT DOCUMENTS

| | | | | |
|---|---|---|---|---|
| 5,682,584 | A * | 10/1997 | Hattori et al. | 399/255 |
| 5,809,383 | A * | 9/1998 | Van Goethem et al. | 399/258 |
| 2004/0179865 | A1 | 9/2004 | Nishiyama | |
| 2007/0274740 | A1 * | 11/2007 | Katoh et al. | 399/254 |
| 2009/0175659 | A1 * | 7/2009 | Sheen | 399/256 |

FOREIGN PATENT DOCUMENTS

| | | |
|---|---|---|
| JP | 2002-328530 | 11/2002 |
| JP | 2004-272017 | 9/2004 |
| JP | 2008-304846 | 12/2008 |
| JP | 2010-164651 | 7/2010 |

* cited by examiner

*Primary Examiner* — Walter L Lindsay, Jr.
*Assistant Examiner* — Benjamin Schmitt
(74) *Attorney, Agent, or Firm* — Nixon & Vanderhye, P.C.

(57) ABSTRACT

A developing device includes a developer tank and a developing roller. An internal space of the developer tank is divided into an upper conveying path, a lower conveying path, a communication path, a main pumping conveying path section, and a developer supply path, by a partition wall. A developer pumping conveying section conveys a developer inside the main pumping conveying path section in a conveyance direction Z, and includes an inner spiral blade, a rotational tube, a first outer spiral blade, a second outer spiral blade, a pumping rotation shaft member, and a pumping gear. An attracting magnet is located in a position horizontally spaced from the rotational tube.

3 Claims, 13 Drawing Sheets

DEVELOPING DEVICE, IMAGE FORMING APPARATUS, DEVELOPER AGITATING AND CONVEYING METHOD

CROSS-REFERENCE TO RELATED APPLICATION

This application claims priority to Japanese Patent Application No. 2010-294280, which was filed on Dec. 28, 2010, the contents of which are incorporated herein by reference in its entirety.

BACKGROUND OF THE TECHNOLOGY

1. Field of the Technology

The present technology relates to a developing device, an image forming apparatus, and a developer agitating and conveying method.

2. Description of the Related Art

A copier, a printer, a facsimile machine or the like is provided with an image forming apparatus which forms an image employing electrophotography. The electrophotographic image forming apparatus forms an electrostatic latent image on a surface of an image bearing member (photoreceptor) by a charging device and an exposure device, supplies a developer by a developing device to develop the electrostatic latent image, transfers a developer image on the photoreceptor onto a recording medium such as a recording paper by a transfer section, and fixes the developer image to the recording paper by a fixing device to form an image.

The developer supplied to the photoreceptor by the developing device is stored in a developer tank provided in the developing device. The developer stored in the developer tank is conveyed to a developing roller provided in the developing device. The developing roller rotates with the developer borne on a surface thereof to supply the developer to the photoreceptor. The developer is charged by frictional electrification in the course of being conveyed to the developing roller. The charged developer moves onto the photoreceptor from the developing roller by electrostatic force between the charged developer and the electrostatic latent image on the surface of the photoreceptor. In this way, the developing device develops the electrostatic latent image on the surface of the photoreceptor to form the developer image.

In recent years, in accordance with the increased process speed of an image forming apparatus and the reduction in size thereof, there is a demand for a developing device which is capable of rapidly and sufficiently charging a developer. For example, Japanese Unexamined Patent Publication JP-A 2004-272017 discloses a circulation type developing device which includes a first conveying path, a second conveying path, a first communication path and a second communication path formed by partition walls installed inside a developer tank, and a developer conveying section which conveys a developer through the first conveying path and the second conveying path in opposite directions. The developer conveying section disclosed in JP-A 2004-272017 has a structure of an auger screw including a rotation shaft member and a spiral blade spirally wound around the rotation shaft member, in which a plate-shaped member (fin) which is parallel with an axial line of the rotation shaft member is installed on the rotation shaft member.

The developer conveying section disclosed in JP-A 2004-272017 conveys the developer in an axial direction of the rotation shaft member by the spiral blade and moves the developer in a circumferential direction of the rotation shaft member by a main surface of the fin, to thereby frictionally charge the moving developer. However, in such a developer conveying section, there is a problem that the developer disposed between the spiral blade and a side surface of the fin is compressed and the compressed developer is not sufficiently frictionally charged. If the developer is not sufficiently charged, the image forming apparatus cannot form a high quality image.

SUMMARY OF THE TECHNOLOGY

The technology is made to solve the above-described problem, and an object thereof is to provide a developing device, an image forming apparatus and a developer agitating and conveying method which are capable of sufficiently charging a developer.

The technology provides a developing device for storing a developer containing a ferromagnetic substance and supplying the developer to an image bearing member to develop an electrostatic latent image formed on the image bearing member, comprising:

a developer tank which stores therein the developer;

a partition wall which divides an internal space of the developer tank into:

an upper conveying path which is located along a longitudinal direction of the partition wall and extends in a substantially horizontal direction, a lower conveying path which extends in the substantially horizontal direction on a vertically lower side of the upper conveying path with the partition wall interposed therebetween, a communication path through which the upper conveying path communicates with the lower conveying path on one end side of the partition wall in the longitudinal direction thereof, and a pumping conveying path through which the upper conveying path communicates with the lower conveying path on another end side of the partition wall in the longitudinal direction thereof and extends in the substantially vertical direction;

an upper developer conveying section which is located in the upper conveying path and conveys the developer in the developer tank in the substantially horizontal direction, the upper developer conveying section conveying the developer toward the other end side the partition wall in the longitudinal direction thereof from the one end side of the partition wall in the longitudinal direction thereof;

a lower developer conveying section which is located in the lower conveying path and conveys the developer in the developer tank in the substantially horizontal direction, the lower developer conveying section conveying the developer toward the one end side of the partition wall in the longitudinal direction thereof from the other end side of the partition wall in the longitudinal direction thereof;

a developer pumping conveying section which is located in the pumping conveying path and conveys the developer in the developer tank upward in a substantially vertical direction, the developer pumping conveying section comprising:

an inner spiral blade having a shape spirally wound around a side surface of an imaginary circular column, the inner spiral blade conveying the developer upward in the substantially vertical direction by a rotational movement around an axial line of the imaginary circular column, and a rotational tube having both ends which are opened in the vertical direction, the rotational tube surrounding an outer circumferential portion of the inner spiral blade, and rotating with the inner spiral blade; and an attracting magnet located in a position spaced from the rotational tube in the horizontal direction, the attracting magnet attracting the developer in the developer tank at least in the horizontal direction.

The developer which is present in a vertically lower part of the pumping conveying path flows into the rotational tube through the opening on the vertically lower side of the rotational tube. Further, the developer is conveyed upward in the vertical direction by the inner spiral blade in the rotational tube and flows outside the rotational tube through the opening on the vertically upper side of the rotational tube. At this time, the rotational tube rotates with the inner spiral blade, and friction occurs due to the rotation between the developer conveyed by the inner spiral blade and an inner wall of the rotational tube. As a result, the developer is charged.

Further, when being conveyed upward in the vertical direction by the inner spiral blade, the developer in the rotational tube is attracted toward the attracting magnet in the horizontal direction inside the rotational tube in the vicinity of the attracting magnet. The attracted developer is conveyed upward in the vertical direction while pressing the inner wall of the rotational tube. Thus, in a position where magnetic force of the attracting magnet acts on the developer, frictional force between the developer and the inner wall of the rotational tube is increased, which more easily charges the developer. In this way, the developing device according to the technology is capable of sufficiently charging the developer.

Further, it is preferable that the attracting magnet is an electromagnet.

Since the attracting magnet is the electromagnet, it is possible to vary the intensity of a generated magnetic field depending on the circumstances unlike a permanent magnet, and to efficiently charge the developer.

Further, it is preferable that the developer pumping conveying section includes a first outer spiral blade which guides the developer which is present outside the rotational tube, toward the opening on the vertically lower side of the rotational tube, the first outer spiral blade being connected to a vertically lower part of the inner spiral blade.

Since the developer is guided toward the opening of the rotational tube by the first outer spiral blade, it is possible to suppress retention of the developer in the vertically lower part of the pumping conveying path.

Further, it is preferable that the developer pumping conveying section includes a second outer spiral blade which guides developer which is present outside the rotational tube, toward the upper conveying path, the second outer spiral blade being connected to a vertically upper part of the inner spiral blade.

Since the developer is guided toward the upper conveying path by the second outer spiral blade, it is possible to suppress intrusion of the developer into a gap between the rotational tube and the developer tank, and to reliably move the developer to the upper conveying path.

Further, it is preferable that the vertically lower part of the pumping conveying path is located vertically below a vertically lower part of the lower conveying path.

The vertically lower part of the pumping conveying path is located below the vertically lower part of the lower conveying path. Thus, compared with a case where the vertically lower part of the pumping conveying path is located vertically above the vertically lower part of the lower conveying path, it is possible to smoothly move the developer to the pumping conveying path.

Further, it is preferable that a vertically upper part of the rotational tube is located above a vertically lower part of the upper conveying path.

The vertically upper part of the rotational tube is located vertically above the vertically lower part of the upper conveying path. Thus, compared with a case where the vertically upper part of the rotational tube is located vertically below the vertically upper part of the lower conveying path, it is possible to smoothly move the developer to the upper conveying path.

Further, it is preferable that the developer tank includes a supply port section for supplying the developer in the developer tank, the supply port section having an opening communicating with the pumping conveying path, the partition wall divides the pumping conveying path into a developer supply path which communicates with the opening of the supply port section and a main pumping conveying path section in which the developer pumping conveying section is located, and the developer supply path communicates with a vertically lower part of the main pumping conveying path section.

The developer supply path communicates with the opening formed in the supply port section to supply the developer, and communicates with the vertically lower part of the main pumping conveying path section in which the developer pumping conveying section is located. Thus, a new developer supplied to the supply port section is rapidly introduced to the opening on the vertically lower side of the rotational tube of the developer pumping conveying section. Thus, it is possible to rapidly mix the developer which is already stored in the developer tank and the newly supplied developer.

Further, the technology provides an electrophotographic image forming apparatus comprising the developing device mentioned above.

The image forming apparatus includes the above-described developing device, and thus, it is possible to sufficiently charge the developer by the developing device. Thus, it is possible to form a stable image with high quality.

Further, the technology provides a developer agitating and conveying method using the above-described developing device, the method comprising the steps of:

operating the electromagnet in a period between a time point when the developer is supplied into the developer tank from the outside of the developer tank and a time point when a predetermined time has elapsed therefrom so that a maximum value of the entire magnetic flux in the rotational tube of a magnetic field generated by the electromagnet is increased compared with a different period; and conveying the developer by the inner spiral blade to convey the developer while agitating the developer.

By operating the attracting magnet (electromagnet) in the period between the time point when the developer is supplied into the developer tank from the outside of the developer tank and the time point when the predetermined time has elapsed therefrom so that the maximum value of the entire magnetic flux in the rotational tube of the magnetic field generated by the attracting magnet (electromagnet) is increased, when a new developer is supplied, it is possible to rapidly charge the developer by the attracting magnet (electromagnet), and when the new developer is not supplied, it is possible to suppress stress generated in the developer.

Further, it is preferable that the electromagnet is intermittently operated.

By operating the attracting magnet (electromagnet) intermittently, the horizontal movement of the developer inside the rotational tube due to the attracting magnet (electromagnet) is actively performed, thereby making it possible to reliably charge the developer.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
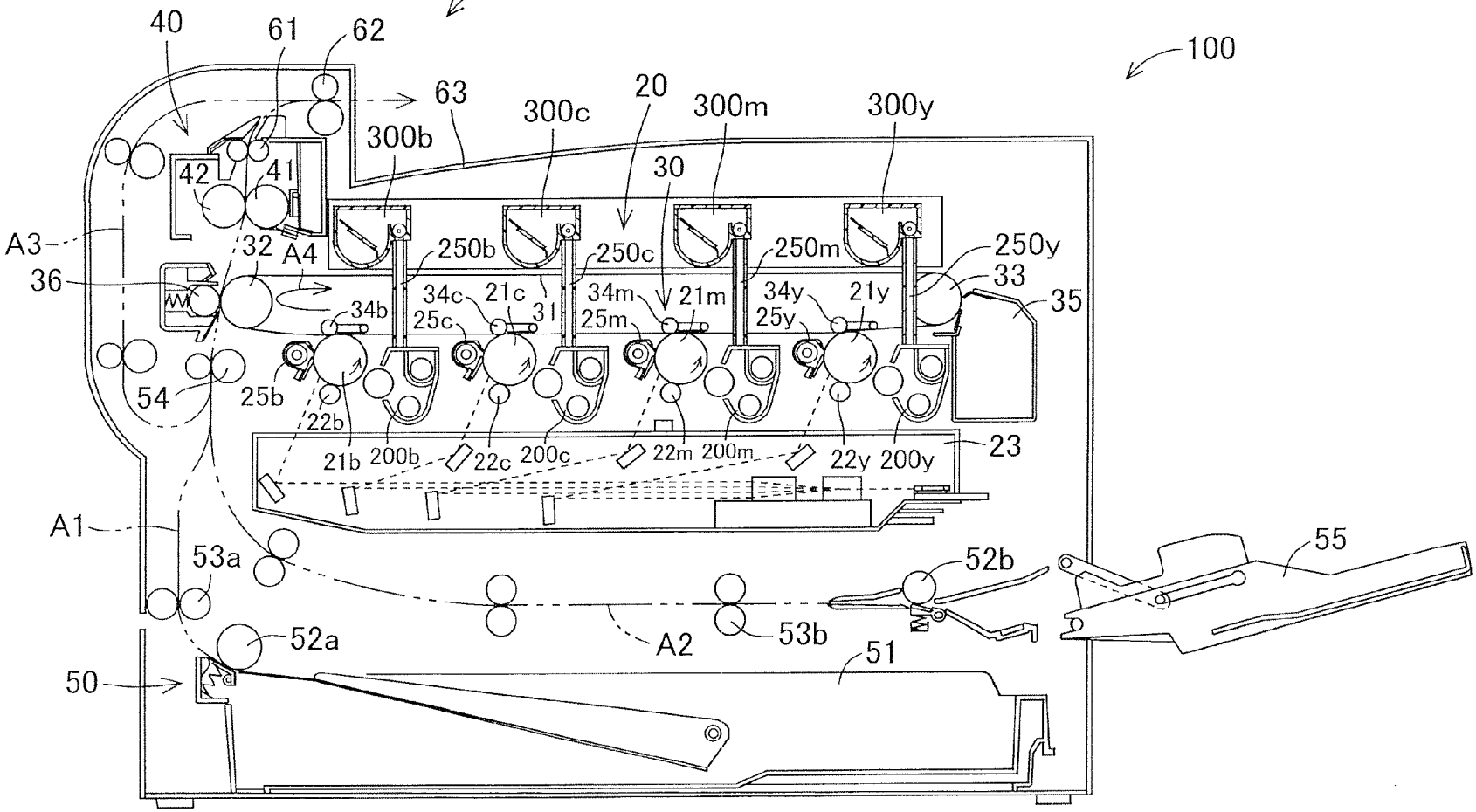
FIG. 1 is a schematic view showing a configuration of an image forming apparatus.

Now referring to the drawings, preferred embodiments are described below.

First, an image forming apparatus 100 having a developing device 200 according to a first embodiment will be described. FIG. 1 is a schematic view showing a configuration of the image forming apparatus 100. The image forming apparatus 100 is a multi-functional peripheral which has a copier function, a printer function, and a facsimile function. A full-color or monochrome image is formed on a recording medium in accordance with the image information transmitted to the image forming apparatus 100.

The image forming apparatus 100 includes a toner image forming section 20, a transfer section 30, a fixing section 40, a recording medium feeding section 50, a discharging section 60, and a control unit section (not shown). The toner image forming section 20 includes photoreceptor drums 21*b*, 21*c*, 21*m*, and 21*y*, charging sections 22*b*, 22*c*, 22*m*, and 22*y*, an exposure unit 23, developing devices 200*b*, 200*c*, 200*m*, and 200*y*, cleaning units 25*b*, 25*c*, 25*m*, and 25*y*, and toner cartridges 300*b*, 300*c*, 300*m*, and 300*y*, and the toner supply pipes 250*b*, 250*c*, 250*m*, and 250*y*. The transfer section 30 includes an intermediate transfer belt 31, a driving roller 32, a driven roller 33, intermediate transfer rollers 34*b*, 34*c*, 34*m*, and 34*y*, a transfer belt cleaning unit 35, and a transfer roller 36.

The photoreceptor drum 21, the charging section 22, the developing device 200, the cleaning unit 25, the toner cartridge 300, the toner supply pipe 250 and the intermediate transfer roller 34 are provided in four sets so as to correspond to the image information of the respective colors of black (b), cyan (c), magenta (m), and yellow (y) which are included in the color image information. In this specification, when the four sets of respective components provided for the respective colors are distinguished, letters indicating the respective colors are affixed to the end of the numbers representing the respective components, and combinations of the numbers and alphabets are used as the reference numerals. When the respective components are collectively referred, only the numerals representing the respective components are used as the reference numerals.

The photoreceptor drum 21 is supported so as to be rotatable around an axial line thereof by a driving section (not shown) and includes a conductive substrate (not shown) and a photoconductive layer (not shown) formed on the surface of the conductive substrate.

The charging section 22, the developing device 200, and the cleaning unit 25 are disposed around the photoreceptor drum 21 in that order in a rotation direction thereof. The charging section 22 is disposed vertically below the developing device 200 and the cleaning unit 25.

The charging section 22 is a device that charges a surface of the photoreceptor drum 21 so as to have predetermined polarity and potential. The charging section 22 is provided along a longitudinal direction of the photoreceptor drum 21 so as to face the photoreceptor drum 21.

The exposure unit 23 is disposed so that light emitted from the exposure unit 23 passes between the charging section 22 and the developing device 200 and reaches the surface of the photoreceptor drum 21.

The developing device 200 is a device that develops an electrostatic latent image formed on the photoreceptor drum 21 with a toner so as to form a toner image on the photoreceptor drum 21. To a vertically upper part of the developing device 200, the toner supply pipe 250 which is a tubular member is connected. Description for the developing device 200 will be given in detail below.

The toner cartridge 300 is arranged vertically above the developing device 200 and stores an unused toner. To a vertically lower part of the toner cartridge 300, the toner supply pipe 250 is connected. The toner cartridge 300 supplies a toner to the developing device 200 through the toner supply pipe 250. Description for the toner cartridge 300 will be given in detail below.

The cleaning unit 25 is a member which removes the toner which remains on the surface of the photoreceptor drum 21 after the toner image has been transferred from the photoreceptor drum 21 to the intermediate transfer belt 31, and thus cleans the surface of the photoreceptor drum 21.

According to the toner image forming section 20, the surface of the photoreceptor drum 21 which is evenly charged by the charging section 22 is irradiated with laser beams corresponding to the image information from the exposure unit 23, whereby electrostatic latent images are formed on the surface of the photoreceptor drum 21. The toner is supplied from the developing device 200 to the electrostatic latent images on the photoreceptor drum 21, whereby toner images are formed. The toner images are transferred to the intermediate transfer belt 31 described later. The toner which remains on the surface of the photoreceptor drum 21 after the toner images has been transferred to the intermediate transfer belt 31 is removed by the cleaning unit 25.

The intermediate transfer belt 31 is an endless belt-shaped member which is disposed vertically above the photoreceptor drum 21. The intermediate transfer belt 31 is supported around the driving roller 32 and the driven roller 33 with tension to form a loop-shaped path and is turned to run in the direction indicated by an arrow A4.

The driving roller 32 is provided so as to be rotatable around an axial line thereof by a driving section (not shown). The intermediate transfer belt 31 is caused to turn by rotation of the driving roller 32 in the direction indicated by the arrow A4. The driven roller 33 is provided so as to be rotatable in accordance with rotation of the driving roller 32 and generates a constant tension in the intermediate transfer belt 31 so that the intermediate transfer belt 31 does not go slack.

The intermediate transfer roller 34 is provided so as to come into pressure-contact with the photoreceptor drum 21 with the intermediate transfer belt 31 interposed therebetween and be rotatable around an axial line thereof by a driving section (not shown). As for the intermediate transfer roller 34, one in which a conductive elastic member is formed on the surface of a roller made of metal (for example, stainless steel) having a diameter of 8 mm to 10 mm can be used, for example. The intermediate transfer roller 34 is connected to a power source (not shown) that applies a transfer bias and has a function of transferring the toner images on the surface of the photoreceptor drum 21 to the intermediate transfer belt 31.

The transfer roller 36 is provided so as to come into pressure-contact with the driving roller 32 with the intermediate transfer belt 31 interposed therebetween and be rotatable around an axial line thereof by a driving section (not shown). In a pressure-contact portion (a transfer nip region) between the transfer roller 36 and the driving roller 32, the toner images which have been borne on the intermediate transfer belt 31 and conveyed to the pressure-contact portion are transferred to a recording medium fed from the recording medium feeding section 50 described later.

The transfer belt cleaning unit 35 is provided so as to face the driven roller 33 with the intermediate transfer belt 31 interposed therebetween and come into contact with a toner image bearing surface of the intermediate transfer belt 31. The transfer belt cleaning unit 35 is provided so as to remove and collect the toner which remains on the surface of the intermediate transfer belt 31 after the toner images have been transferred to the recording medium.

According to the transfer section 30, when the intermediate transfer belt 31 is turned to run while making contact with the photoreceptor drum 21, a transfer bias having a polarity opposite to the polarity of the charged toner on the surface of the photoreceptor drum 21 is applied to the intermediate transfer roller 34, and the toner images formed on the surface of the photoreceptor drum 21 are transferred to the intermediate transfer belt 31. The toner images of the respective colors formed by the respective photoreceptor drums 21*y*, 21*m*, 21*c*, and 21*b* are sequentially transferred and overlaid onto the intermediate transfer belt 31, whereby full-color toner images are formed. The toner images transferred to the intermediate transfer belt 31 are conveyed to the transfer nip region by turning movement of the intermediate transfer belt 31, and the toner images are transferred to the recording medium in the transfer nip region. The recording medium on which the toner images are transferred is conveyed to a fixing section 40 described later.

The recording medium feeding section 50 includes a paper feed box 51, pickup rollers 52*a* and 52*b*, conveying rollers 53*a* and 53*b*, registration rollers 54, and a paper feed tray 55. The paper feed box 51 is a container-shaped member which is disposed in a vertically lower part of the image forming apparatus 100 so as to store recording mediums at the inside of the image forming apparatus 100. The paper feed tray 55 is a tray-shaped member which is provided on an outer wall surface of the image forming apparatus 100 so as to store recording mediums outside the image forming apparatus 100.

The pickup roller 52*a* is a member which takes out the recording mediums stored in the paper feed box 51 sheet by sheet and feeds the recording medium to a paper conveyance path A1. The conveying rollers 53*a* are a pair of roller-shaped members disposed so as to come into pressure-contact with each other, and convey the recording medium towards the registration rollers 54 along the paper conveyance path A1. The pickup roller 52*b* is a member which takes out the recording mediums stored in the paper feed tray 55 sheet by sheet and feeds the recording medium to a paper conveyance path A2. The conveying rollers 53*b* are a pair of roller-shaped members disposed so as to come into pressure-contact with each other, and convey the recording medium towards the registration roller 54 along the paper conveyance path A2.

The registration rollers 54 are a pair of roller-shaped members disposed so as to come into pressure-contact with each other, and feed the recording medium fed from the conveying rollers 53*a* and 53*b* to the transfer nip region in synchronization with the conveyance of the toner images borne on the intermediate transfer belt 31 to the transfer nip region.

According to the recording medium feeding section 50, the recording medium is fed from the paper feed box 51 or the paper feed tray 55 to the transfer nip region in synchronization with the conveyance of the toner images borne on the intermediate transfer belt 31 to the transfer nip region, and the toner images are transferred to the recording medium.

The fixing section 40 includes a heating roller 41 and a pressure roller 42. The heating roller 41 is controlled so as to maintain a predetermined fixing temperature. The pressure roller 42 is a roller that comes into pressure-contact with the heating roller 41. The heating roller 41 and the pressure roller 42 pinch the recording medium under application of heat, thus fusing the toner of the toner images so as to be fixed to the recording medium. The recording medium to which the toner images have been fixed is conveyed to the discharging section 60 described later.

The discharging section 60 includes conveying rollers 61, discharge rollers 62, and a catch tray 63. The conveying rollers 61 are a pair of roller-shaped members which is disposed vertically above the fixing section 40 so as to come into pressure-contact with each other. The conveying rollers 61 convey the recording medium on which images have been fixed towards the discharge rollers 62.

The discharge rollers 62 are a pair of roller-shaped members which is disposed so as to come into contact with each other. In the case of single-side printing, the discharge rollers 62 discharge a recording medium on which single-side printing has finished to the catch tray 63. In the case of double-side printing, the discharge rollers 62 convey a recording medium on which single-side printing has finished to the registration rollers 54 along the paper conveyance path A3 and then discharges a recording medium on which double-side printing has finished to the discharge tray 63. The catch tray 63 is provided on the vertically upper surface of the image forming apparatus 100 so as to store recording mediums to which images have been fixed.

The image forming apparatus 100 includes the control unit section (not shown). The control unit section is provided in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD).

The computing portion takes out various kinds of data (for example, image formation commands, detection results, and image information) written in the memory portion and the programs for various processes and then makes various determinations. The control portion sends a control signal to the respective devices provided in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices provided in the image forming apparatus 100.

Figure 2:
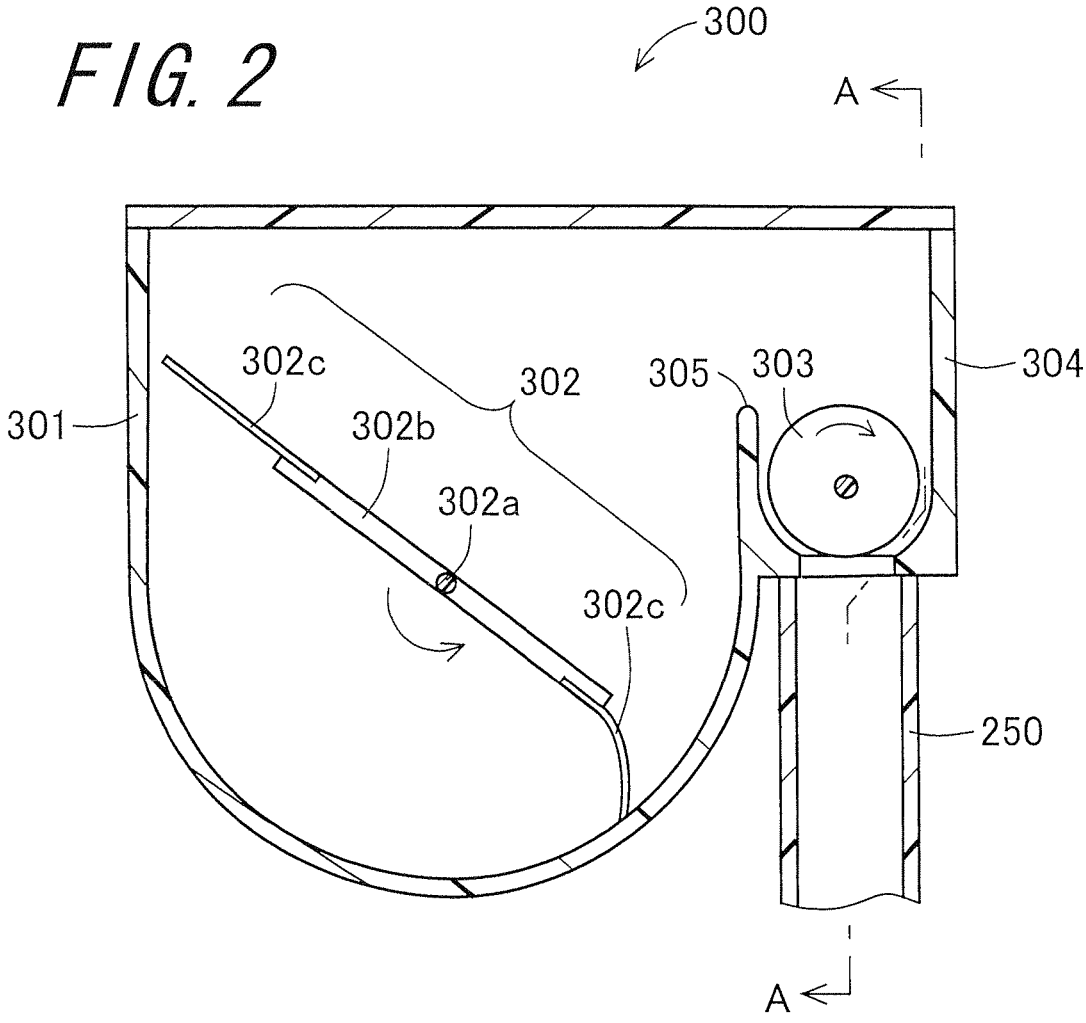
FIG. 2 is a schematic view showing a configuration of a toner cartridge.
Figure 3:
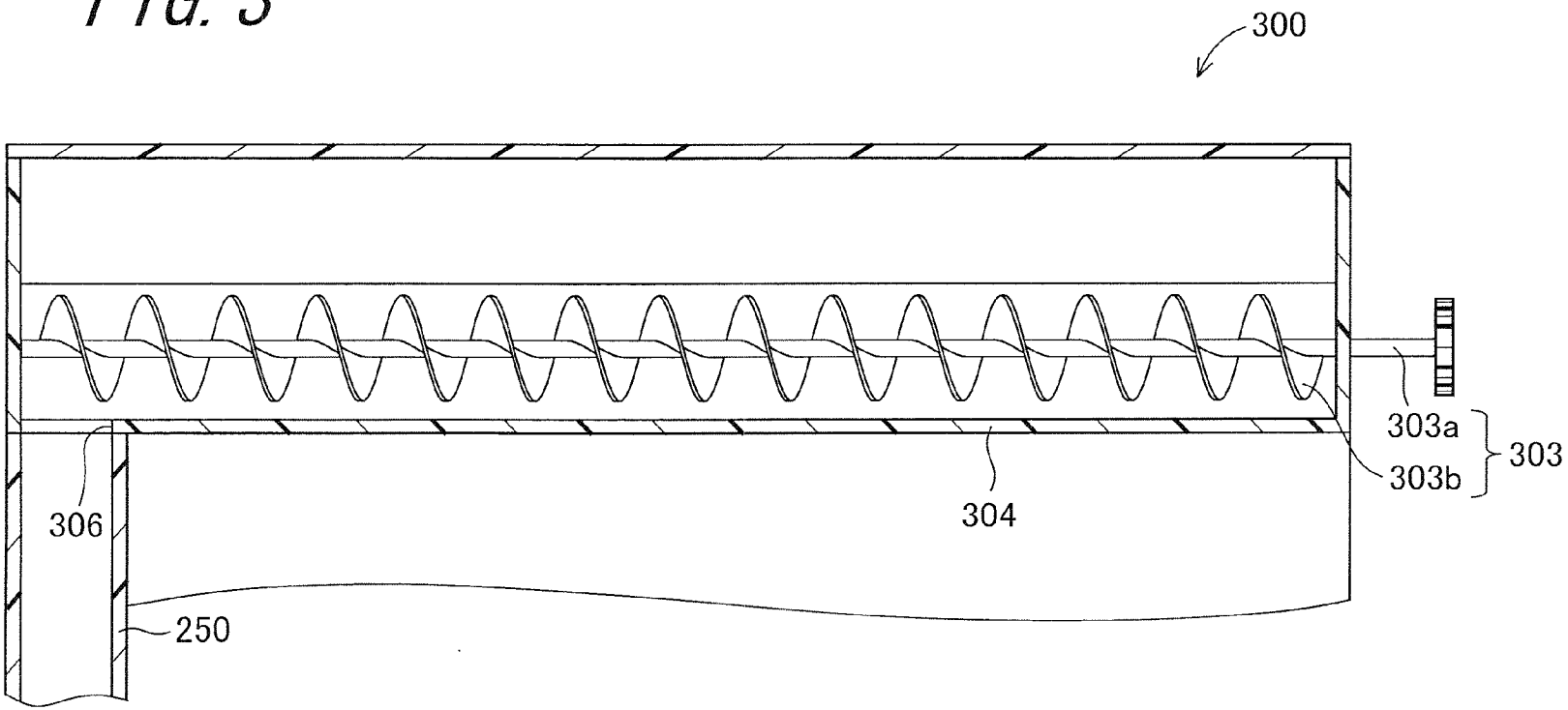
FIG. 3 is a sectional view of the toner cartridge taken along the line A-A of FIG. 2.

FIG. 2 is a schematic view showing a configuration of the toner cartridge 300. FIG. 3 is a sectional view of the toner cartridge 300 taken along the line A-A of FIG. 2. The toner cartridge 300 is a device that supplies a toner to the developing device 200 through the toner supply pipe 250. The toner cartridge 300 includes a toner container 301, a toner scooping member 302, a toner discharge member 303 and a toner discharge container 304.

The toner container 301 is a container-like member having an approximately semicircular columnar internal space, and in the internal space, supports the toner scooping member 302 so as to freely rotate and contains an unused toner. The toner discharge container 304 is a container-like member having an approximately semicircular columnar internal space provided along a longitudinal direction of the toner container 301, and in the internal space, supports the toner discharge member 303 so as to freely rotate. The internal space of the toner container 301 and the internal space of the toner discharge container 304 communicate with each other through a communicating opening 305 formed along the longitudinal direction of the toner container 301. The toner discharge container 304 has a discharge port 306 formed on a vertically lower part thereof. To the discharge port 306 of the toner discharge container 304, the toner supply pipe 250 is connected.

The toner scooping member 302 includes a rotation shaft 302*a*, a base member 302*b* and a sliding section 302*c*. The rotation shaft 302*a* is a column-shaped member extending along a longitudinal direction of the toner container 301. The base member 302*b* is a plate-like member extending along the longitudinal direction of the toner container 301, and attached to the rotation shaft 302*a* at a center in a width direction and a thickness direction thereof. The sliding section 302*c* is a member having flexibility and attached to both ends in the width direction of the base member 302*b*, and is formed of, for example, polyethylene terephthalate (PET). The toner scooping member 302 scoops the toner inside the toner container 301 into the toner discharge container 304 by which the base member 302*b* performs rotation motion following rotation of the rotation shaft 302*a* around the axial line thereof, whereby the sliding section 302*c* provided at the both ends in the width direction of the base member 302*b* slides on an inner wall face of the toner container 301.

The toner discharge member 303 is a member that conveys the toner inside the toner discharge container 304 toward the discharge port 306. The toner discharge member 303 is a so-called auger screw including a toner discharge rotation shaft 303*a*, and a toner discharge blade 303*b* provided around the toner discharge rotation shaft 303*a*.

According to the toner cartridge 300, an unused toner in the toner container 301 is scooped into the toner discharge container 304 by the toner scooping member 302. Then, the toner scooped by the toner discharge container 304 is conveyed to the discharge port 306 by the toner discharge member 303. The toner conveyed to the discharge port 306 is discharged from the discharge port 306 to the outside of the toner discharge container 304, and supplied to the developing device 200 through the toner supply pipe 250.

Figure 4:
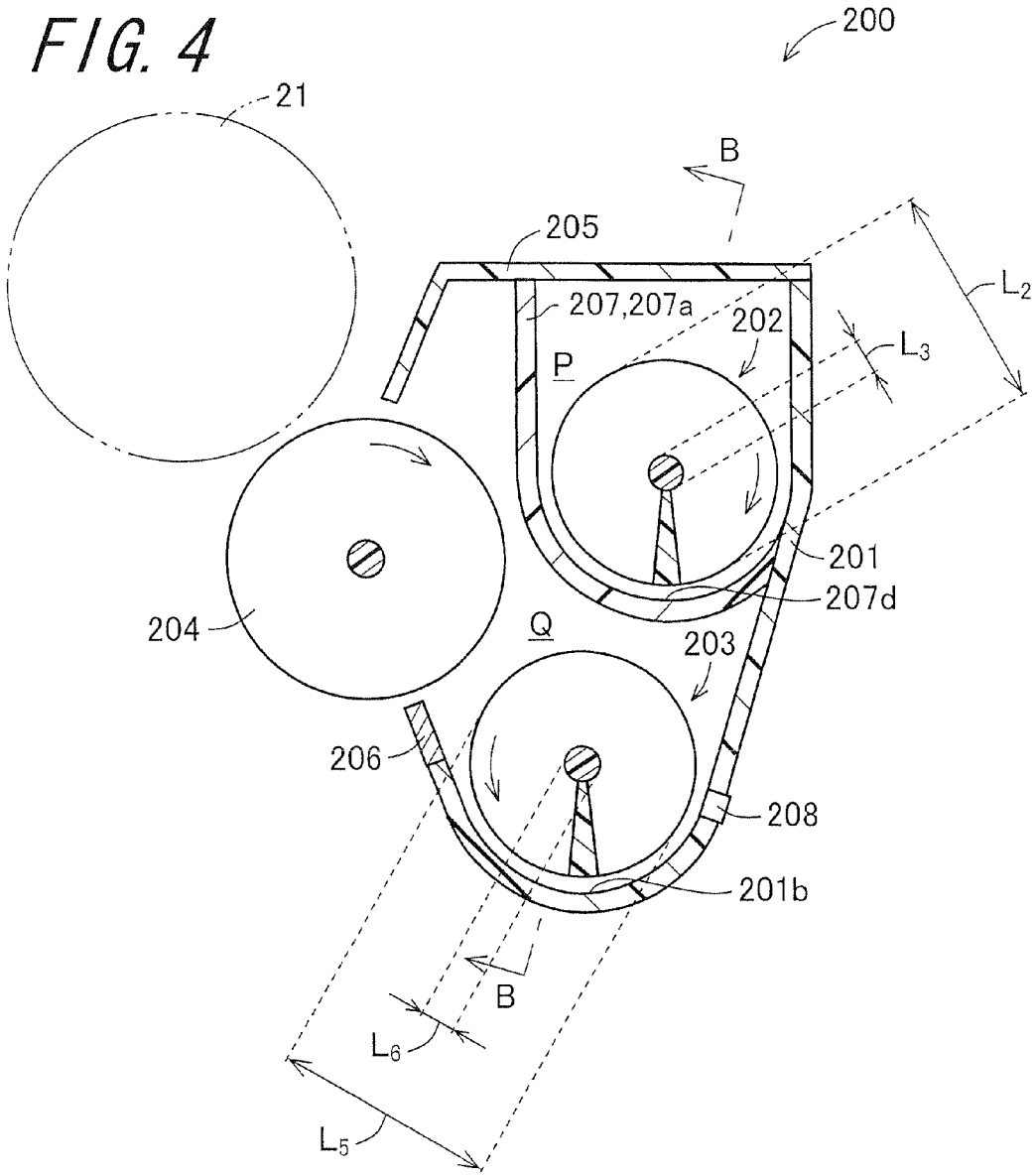
FIG. 4 is a schematic view illustrating a configuration of a developing device.
Figure 5:
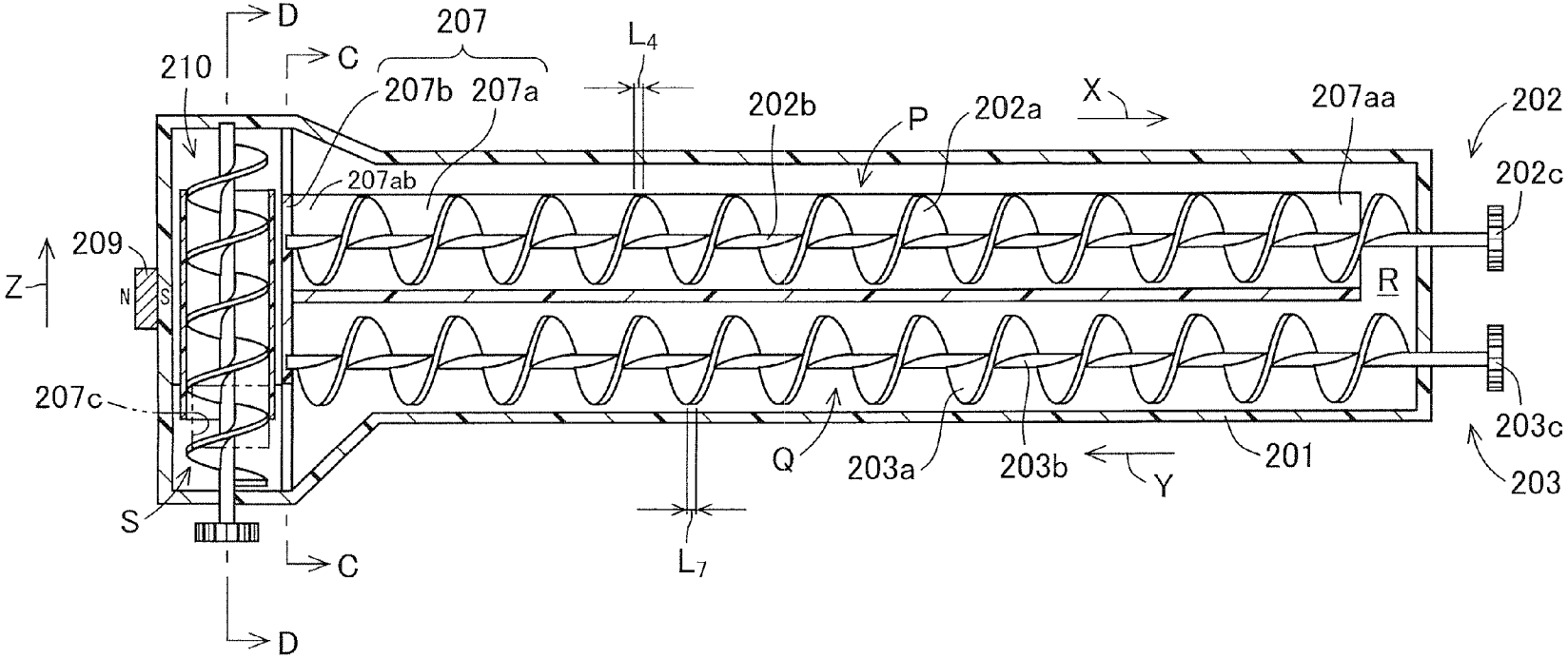
FIG. 5 is a view illustrating a part of the developing device taken along line B-B shown in FIG. 4.
Figure 6:
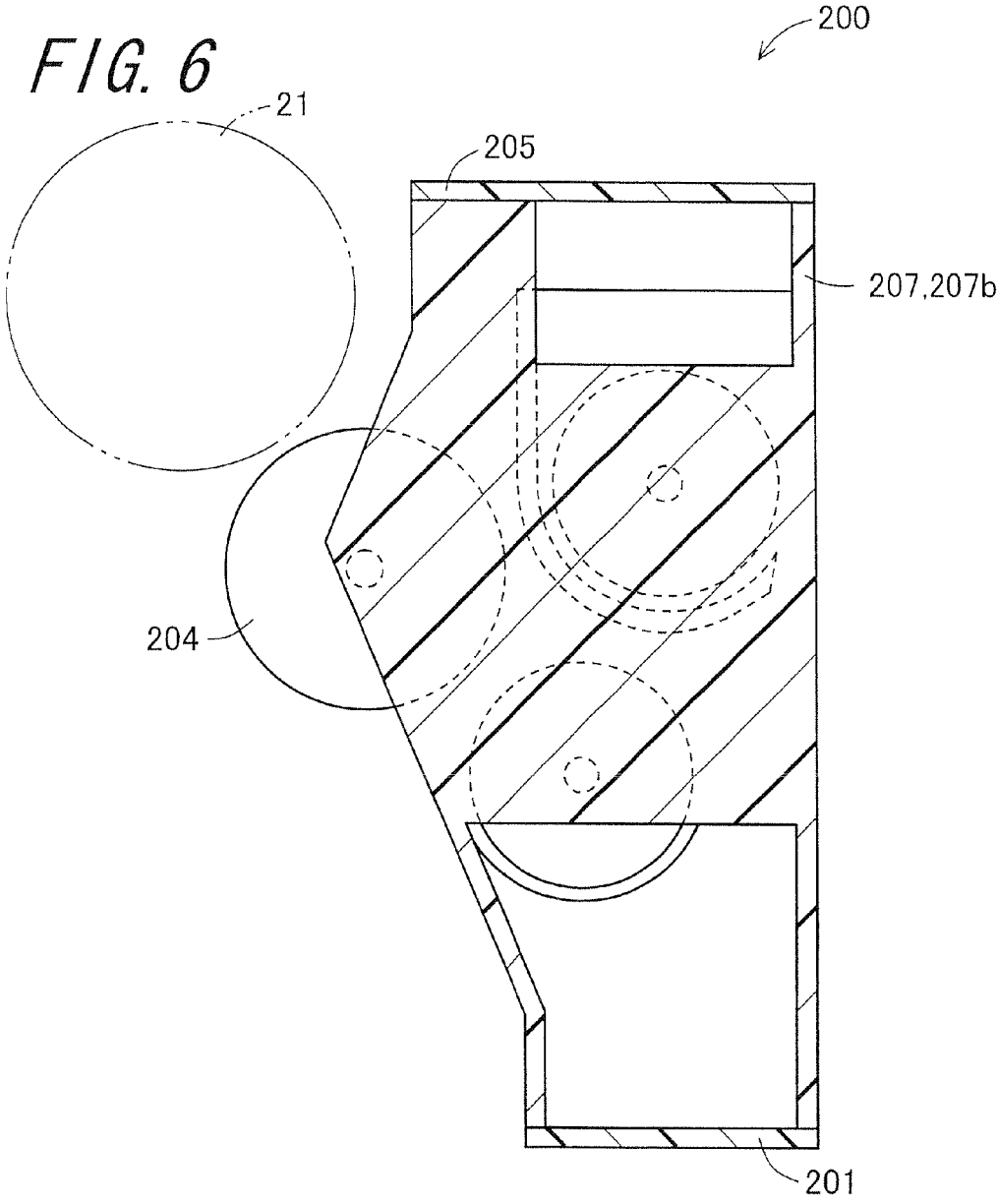
FIG. 6 is a cross-sectional view illustrating the developing device taken along line C-C shown in FIG. 5.
Figure 7:
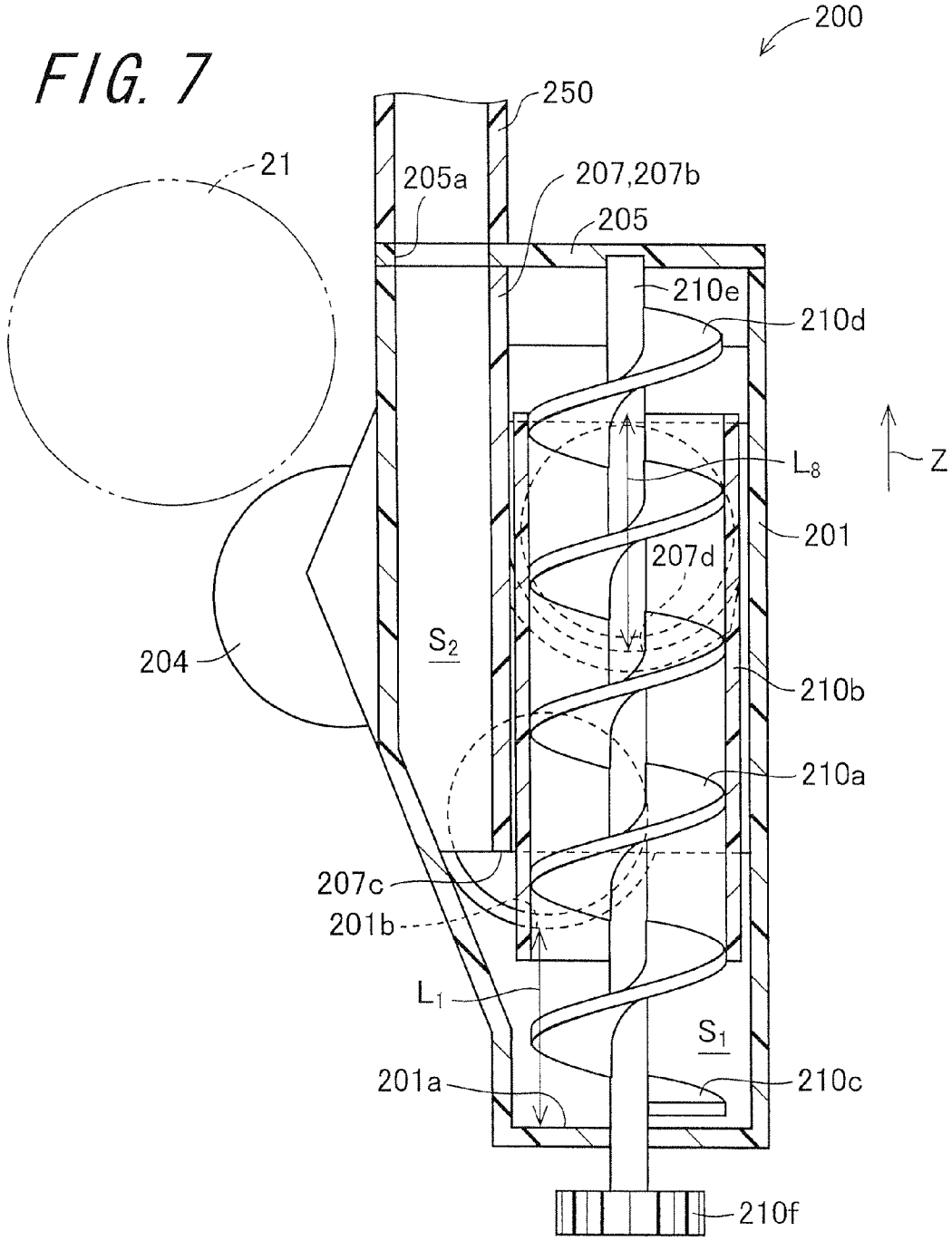
FIG. 7 is a view illustrating a part of the developing device taken along line D-D shown in FIG. 5.

FIG. 4 is a schematic view illustrating a configuration of the developing device 200. FIG. 5 is a view illustrating a part of the developing device 200, taken along line B-B shown in FIG. 4. FIG. 6 is a cross-sectional view illustrating the developing device 200 taken along line C-C shown in FIG. 5. FIG. 7 is a view illustrating a part of the developing device 200 taken along line D-D shown in FIG. 5. The developing device 200 is a device that supplies a toner to a surface of the photoreceptor drum 21 to develop an electrostatic latent image formed on the surface of the photoreceptor drum 21. The developing device 200 includes a developer tank 201, an upper developer conveying section 202, a lower developer conveying section 203, a developing roller 204, a developer tank cover 205, a doctor blade 206, a partition wall 207, a toner concentration detecting sensor 208, an attracting magnet 209, and a developer pumping conveying section 210.

The developer tank 201 is a member having an internal space, and stores the developer in the internal space. Examples of the developer used in the embodiment include a single-component developer composed of a toner which contains a ferromagnetic substance. Further, Examples of the developer used in the embodiment include a two-component developer which contains a ferromagnetic substance, that is, a two-component developer which contains a toner containing a ferromagnetic substance and a carrier known in the related art, a two-component developer which contains a toner known in the related art and a carrier containing a ferromagnetic substance, or a two-component developer which contains a toner containing a ferromagnetic substance and a carrier containing a ferromagnetic substance.

In the developer tank 201, the developer tank cover 205 is located on a vertically upper side, and in the internal space thereof, the upper developer conveying section 202, the lower developer conveying section 203, the developing roller 204, the doctor blade 206, the partition wall 207, the attracting magnet 209, and the developer pumping conveying section 210 are located. Further, in a vertically lower part (bottom part) of the developer tank 201, the toner concentration detecting sensor 208 is located. Further, the developer tank 201 has an opening section between the photoreceptor drum 21 and the developing roller 204.

The developing roller 204 includes a magnet roller, bears the developer in the developer tank 201 on a surface thereof, and then supplies the toner included in the borne developer to the photoreceptor drum 21. A power source (not shown) is connected to the developing roller 204, and applies a developing bias voltage thereto. The toner borne by the developing roller 204 is moved to the photoreceptor drum 21 by electrostatic force due to the developing bias voltage around the photoreceptor drum 21.

The doctor blade 206 is a plate-like member extending in an axial line direction of the developing roller 204, and is provided so that one end in a width direction thereof is fixed to the developer tank 201, and another end thereof has a clearance with respect to the surface of the developing roller 204. The doctor blade 206 is provided so as to have a clearance with respect to the surface of the developing roller 204, and an amount of developer borne on the developing roller 204 is thereby regulated to a predetermined amount. As a material of the doctor blade 206, stainless steel, aluminum, a synthetic resin, or the like is usable.

The developer tank cover 205 is detachably located in a vertically upper part of the developer tank 201, and has a supply port section 205*a*. In the developer tank cover 205, a toner supply pipe 250 is connected to the supply port section 205*a*. The supply port section 205*a* is an opening section in which an opening communicating with the internal space in the developer tank 201 is formed, so as to supply the toner into the developer tank 201. The toner contained in the toner cartridge 300 is supplied to the developer tank 201 through the toner supply pipe 250 and the opening thereof.

The partition wall 207 is a member which divides the internal space of the developer tank 201, and includes an approximately U-shaped horizontal partition wall 207*a* which extends in a substantially horizontal direction and a vertical partition wall 207*b* which extends in a substantially vertical direction. In the embodiment, the "substantially horizontal direction" means that it has at least a horizontal direction component, and that the horizontal direction component is larger than the vertical direction component in a case where it also has a vertical direction component. Further, the "substantially vertical direction" means that it has at least a vertical direction component, and that the vertical direction component is larger than the horizontal direction component in a case where it also has a horizontal direction component. One end 207*aa* of the horizontal partition wall 207*a* in a longitudinal direction thereof is located so as to be spaced from an inner wall of the developer tank 201, and another end 207*ab* of the horizontal partition wall 207*a* in the longitudinal direction thereof is connected to the vertical partition wall 207*b*. The internal space of the developer tank 201 is divided into an upper conveying path P, a lower conveying path Q, a communication path R, and a pumping conveying path S by the horizontal partition wall 207*a* and the vertical partition wall 207*b*. The pumping conveying path S is divided into a main pumping conveying path section $S_1$ and a developer supply path $S_2$ by the vertical partition wall 207*b*.

The upper conveying path P is an approximately semi-circular cylindrical space which extends in the substantially horizontal direction along a longitudinal direction of the horizontal partition wall 207*a*. The lower conveying path Q is formed on a vertically lower side of the upper conveying path P, and is an approximately semi-circular cylindrical space which extends in the substantially vertical direction, which is a space which faces the upper conveying path P with the horizontal partition wall 207*a* interposed therebetween. The communication path R is a space where the upper conveying path P and the lower conveying path Q communicate with each other on the side of the one end 207*aa* of the horizontal partition wall 207*a* in the longitudinal direction thereof. The pumping conveying path S is a space where the upper conveying path P and the lower conveying path Q communicate with each other on the side of the other end 207*ab* of the horizontal partition wall 207*a* in the longitudinal direction thereof, and is a space where it extends in the substantially vertical direction.

The main pumping conveying path section $S_1$ is an approximately cylindrical space which extends in the substantially vertical direction, and the developer supply path $S_2$ is an approximately columnar space which extends in the substantially vertical direction. An opening 207*c* is formed in a vertically lower part of the vertical partition wall 207*b*. A vertically lower part of the main pumping conveying path section $S_1$ and a vertically lower part of the developer supply path $S_2$ communicate with each other through the opening 207*c*. Further, a vertically upper part of the developer supply path $S_2$ communicates with the opening formed in the supply port section 205*a* of the developer tank cover 205.

The vertically lower part of the main pumping conveying path section $S_1$ is formed vertically below a vertically lower part of the lower conveying path Q. That is, in a bottom part of the developer tank 201, a surface 201*a* which faces the main pumping conveying path section $S_1$ is formed vertically below a surface 201*b* which faces the lower conveying path Q. A distance $L_1$ in the vertical direction between the surface 201*a* which faces the main pumping conveying path section $S_1$ and the surface 201*b* which faces the lower conveying path Q is appropriately set in the range of 5 mm or more and 20 mm or less.

The upper developer conveying section 202 is located in the upper conveying path P. The upper developer conveying section 202 conveys the developer in the developer tank 201 in the substantially horizontal direction, from the side of the other end 207*ab* of the horizontal partition wall 207*a* in the longitudinal direction thereof toward the side of the one end 207*aa* in the longitudinal direction thereof. Hereinafter, the conveyance direction of the developer through the upper developer conveying section 202 is referred to as a conveyance direction X.

The upper developer conveying section 202 is an auger screw shaped member, and includes an upper spiral blade 202*a*, an upper rotation shaft member 202*b* and an upper gear 202*c*. The upper rotation shaft member 202*b* is a cylindrical member which extends in the conveyance direction X, one end in a longitudinal direction thereof is connected to the upper gear 202*c* outside the developer tank 201, and another end in the longitudinal direction thereof is rotatably supported by the vertical partition wall 207*b*.

The upper spiral blade 202*a* has a shape spirally wound around the upper rotation shaft member 202*b*, and rotates with 60 rpm to 180 rpm around an axial line of the upper rotation shaft member 202*b*, through the upper rotation shaft member 202*b* and the upper gear 202*c* by a driving section such as a motor. The developer stored in the upper conveying path P is conveyed to a downstream side in the conveyance direction X, by rotation of the upper spiral blade 202*a*. The developer conveyed to the downstream side in the conveyance direction X moves to the communication path R, drops downward in the vertical direction in the communication path R, and moves to the lower conveying path Q.

A value of two times the distance between the axial line of the upper rotation shaft member 202*b* and a point on the upper spiral blade 202*a* which is the most distant therefrom is referred to as an external diameter $L_2$ of the upper spiral blade 202*a*. Further, a value of two times the distance between the axial line of the upper rotation shaft member 202*b* and a point on the upper spiral blade 202*a* which is the closest thereto is referred to as an internal diameter $L_3$ of the upper spiral blade 202*a*. The external diameter $L_2$ of the upper spiral blade 202*a* is appropriately set in the range of 15 mm or more and 35 mm or less, and the internal diameter $L_3$ of the upper spiral blade 202*a* is appropriately set in the range of 5 mm or more and 15 mm or less. Further, a thickness $L_4$ of the upper spiral blade 202*a* is appropriately set in the range of 1 mm or more and 3 mm or less.

The lower developer conveying section 203 is located in the lower conveying path Q. The lower developer conveying section 203 conveys the developer in the developer tank 201 in the substantially horizontal direction, from the side of the one end 207*aa* of the horizontal partition wall 207*a* in the longitudinal direction thereof toward the side of the other end 207*ab* in the longitudinal direction thereof. Hereinafter, the conveyance direction of the developer through the lower developer conveying section 203 is referred to as a conveyance direction Y.

The lower developer conveying section 203 is an auger screw shaped member, and includes a lower spiral blade 203*a*, a lower rotation shaft member 203*b* and a lower gear 203*c*. The lower rotation shaft member 203*b* is a cylindrical member which extends in the conveyance direction Y, one end in a longitudinal direction thereof is connected to the lower gear 203*c* outside the developer tank 201, and another end in the longitudinal direction thereof is rotatably supported by the vertical partition wall 207*b*.

The lower spiral blade 203*a* is a shape spirally wound around the lower rotation shaft member 203*b*, and rotates with 60 rpm to 180 rpm around an axial line of the lower rotation shaft member 203*b*, through the lower rotation shaft member 203*b* and the lower gear 203*c* by a driving section such as a motor. The developer stored in the lower conveying path Q is conveyed to a downstream side in the conveyance direction Y, by rotation of the lower spiral blade 203*a*. The developer conveyed to the downstream side in the conveyance direction Y moves to the main pumping conveying path section $S_1$.

A value of two times the distance between the axial line of the lower rotation shaft member 203*b* and a point on the lower spiral blade 203*a* which is the most distant therefrom is referred to as an external diameter $L_5$ of the lower spiral blade 203*a*. Further, a value of two times the distance between the axial line of the lower rotation shaft member 203*b* and a point on the lower spiral blade 203*a* which is the closest thereto is referred to as an internal diameter $L_6$ of the lower spiral blade 203*a*. The external diameter $L_5$ of the lower spiral blade 203*a* is appropriately set in the range of 15 mm or more and 35 mm or less, and the internal diameter $L_6$ of the lower spiral blade 203*a* is appropriately set in the range of 5 mm or more and 15 mm or less. Further, a thickness $L_7$ of the lower spiral blade 203*a* is appropriately set in the range of 1 mm or more and 3 mm or less.

The developer pumping conveying section 210 is located in the main pumping conveying path section $S_1$, and conveys the developer in the developer tank 201 upward in the substantially vertical direction. Hereinafter, the conveyance direction of the developer through the developer pumping conveying section 210 is referred to as a conveyance direction Z.

The developer pumping conveying section 210 includes an inner spiral blade 210*a*, a rotational tube 210*b*, a first outer spiral blade 210*c*, a second outer spiral blade 210*d*, a pumping rotation shaft member 210*e*, and a pumping gear 210*f*. The pumping rotation shaft member 210*e* is a cylindrical member which extends in the conveyance direction Z, and one end in a longitudinal direction thereof is connected to the pumping gear 210*f* outside the developer tank 201, and another end in the longitudinal direction thereof is rotatably supported by the developer tank cover 205.

The inner spiral blade 210*a* has a shape spirally wound around an imaginary circular column which extends in the conveyance direction Z, and is spirally wound around the cylindrical pumping rotation shaft member 210*e* in the embodiment. The inner spiral blade 210*a* rotates with 60 rpm to 180 rpm around an axial line of the imaginary circular column, through the pumping rotation shaft member 210*e* and the pumping gear 210*f* by a driving section such as a motor. The developer stored in the main pumping conveying path section $S_1$ is conveyed upward in the substantially vertical direction, by rotation of the inner spiral blade 210*a*. The inner spiral blade 210*a* may be driven without intervention of the pumping rotation shaft member 210*e*, as another embodiment.

The rotational tube 210*b* is a member which surrounds an outer circumferential portion of the inner spiral blade 210*a* and rotates with the inner spiral blade 210*a*. The rotational tube 210*b* extends in the substantially vertical direction and an upstream end and a downstream end thereof in the conveyance direction Z are opened.

A vertically upper part of the rotational tube 210*b* is formed vertically above a vertically lower part of the upper conveying path P. That is, a downstream end of the rotational tube 210*b* in the conveyance direction Z is located vertically above a surface 207*d* of the horizontal partition wall 207*a* which faces the upper conveying path P. A distance $L_8$ in the vertical direction between the downstream end of the rotational tube 210*b* in the conveyance direction Z and the surface 207*d* of the horizontal partition wall 207*a* which faces the upper conveying path P is appropriately set in the range of 40 mm or more and 100 mm or less.

The first outer spiral blade 210*c* is connected to a vertically lower part of the inner spiral blade 210*a* and rotates with the inner spiral blade 210*a*, to thereby convey the developer which is present outside the rotational tube 210*b*, more specifically, the developer around the opening of the rotational tube 210*b* on the upstream side in the conveyance direction Z, to the downstream side in the conveyance direction Z. Thus, the first outer spiral blade 210*c* guides the developer which is present outside the rotational tube 210*b* to the opening of the rotational tube 210*b* which is on the upstream side in the conveyance direction Z. The developer guided to the opening is conveyed to the downstream side in the conveyance direction Z by the inner spiral blade 210*a*.

The second outer spiral blade 210*d* is connected to a vertically upper part of the inner spiral blade 210*a* and rotates with the inner spiral blade 210*a*, to thereby convey the developer which is present outside the rotational tube 210*b*, more specifically, the developer around the opening of the rotational tube 210*b* on the downstream side in the conveyance direction Z, to the downstream side in the conveyance direction Z. At this time, the developer conveyed by the second outer spiral blade 210*d* is subjected to centrifugal force by the second outer spiral blade 210*d* and moves in a diameter direction of the pumping rotation shaft member 210*e*. As a result, the developer which is present outside the rotational tube 210*b* is guided to the upper conveying path P.

The attracting magnet 209 is located in a position spaced from the rotational tube 210*b* in the horizontal direction in an area ranging from the downstream end of the rotational tube 210*b* in the conveyance direction Z to the upstream end thereof, and attracts at least a part of the developer in the rotational tube 210*b* in the horizontal direction. Since the rotational tube 210*b* extends in the substantially vertical direction, the developer in the rotational tube 210*b* is attracted toward an inner wall of the rotational tube 210*b*.

In the embodiment, the attracting magnet 209 is fixed in a position which faces the vertical partition wall 207*b* with the main pumping conveying path section $S_1$ interposed therebetween, outside the developer tank 201. As another embodiment, the attracting magnet 209 may be fixed in the developer tank 201. Further, as still another embodiment, a plurality of attracting magnets 209 may be located at a predetermined interval in the conveyance direction Z.

In the embodiment, as the attracting magnet 209, a permanent magnet such as a ferrite magnet is used. More specifically, a rectangular anisotropic ferrite magnet manufactured by Magfine Corporation (length of 12 mm, width of 12 mm, thickness of 2 mm, and magnetic flux density of 70 mT) is separated by 12 mm from a point on an axial line of the rotational tube 210*b* in the horizontal direction, and a magnetic pole of the magnet is located toward this point, to thereby generate a magnetic field of the magnetic flux density of about 50 mT at this point. A value of the magnetic flux density of the magnetic field generated by the attracting magnet 209 is not limited to this value. By appropriately changing the intensity or arrangement of the magnet, a magnetic field of the magnetic flux density of about 30 mT to about 100 mT may be generated at the point on the axial line of the rotational tube 210*b*.

The toner concentration detecting sensor 208 is mounted on a bottom part of the developer tank 201 which faces a central portion of the lower conveying path Q in the conveyance direction Y so that a sensing surface thereof is exposed to the lower conveying path Q. The toner concentration detecting sensor 208 is electrically connected to a toner concentration control section (not shown).

The toner concentration control section performs control of rotating a toner discharge member 303 of the toner cartridge 300 according to the toner concentration detecting result detected by the toner concentration detecting sensor 208 and supplying the toner into the developer tank 201. More specifically, the toner concentration control section determines whether the toner concentration detecting result through the toner concentration detecting sensor 208 is lower than a predetermined set value. In a case where it is determined that the toner concentration detecting result is lower than the predetermined set value, the toner concentration control section sends a control signal to a driving section which rotates the toner discharge member 303, and rotates the toner discharge member 303 for a predetermined period.

A power source (not shown) is connected to the toner concentration detecting sensor 208. The power source applies a driving voltage for driving the toner concentration detecting sensor 208 and a control voltage for outputting the toner concentration detecting result to the toner concentration control section to the toner concentration detecting sensor 208. Application of voltage to the toner concentration detecting sensor 208 by the power source is controlled according to a control section (not shown).

As the toner concentration detecting sensor 208, a general toner concentration detecting sensor may be used, for example, a transmitted light detecting sensor, a reflected light detecting sensor, a magnetic permeability detecting sensor, or the like may be used. It is preferable that the magnetic permeability detecting sensor is used among these toner concentration detecting sensors. As the magnetic permeability detecting sensor, for example, TS-L (product name, manufactured by TDK corporation), TS-A (product name, manufactured by TDK corporation), TS-K (product name, manufactured by TDK corporation), or the like may be used.

According to the developing device 200 with such a configuration, in the developer tank 201, the developer is circulation-conveyed in the order of the main pumping conveying path section $S_1$, the upper conveying path P, the communication path R, and the lower conveying path Q. A part of the developer which is circulation-conveyed in this way is borne on the surface of the developing roller 204 in the lower conveying path Q, and the toner in the borne developer moves to the photoreceptor drum 21 and is sequentially consumed. If the toner concentration detecting sensor 208 detects that the predetermined amount of the toner is consumed, an unused toner is supplied to the developer supply port $S_2$ from the toner cartridge 300. The supplied toner moves the main pumping conveying path section $S_1$ and is circulation-conveyed.

Figure 8:
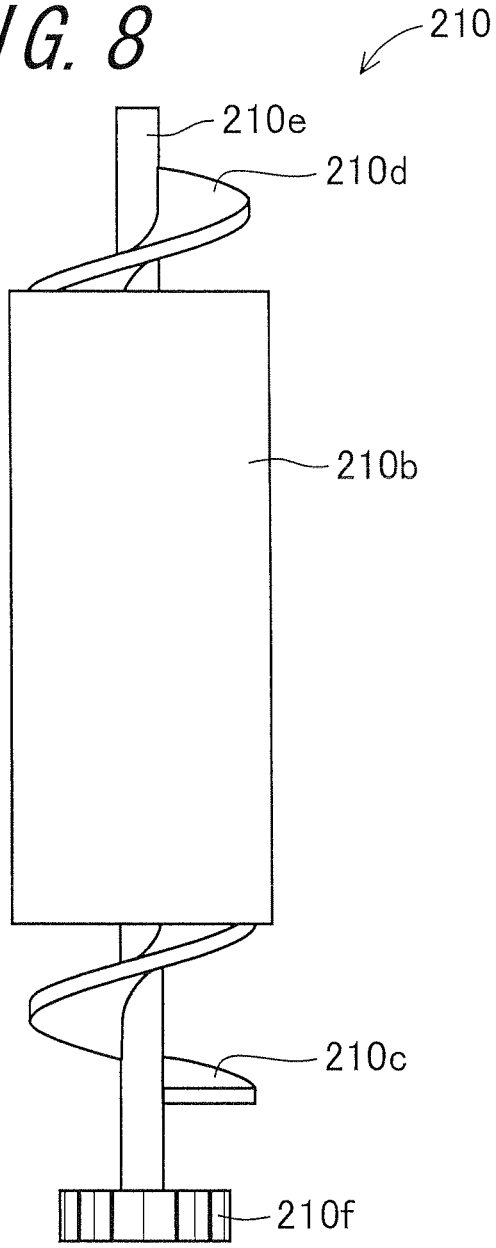
FIG. 8 is a schematic view illustrating an entire developer pumping conveying section.
Figure 9:
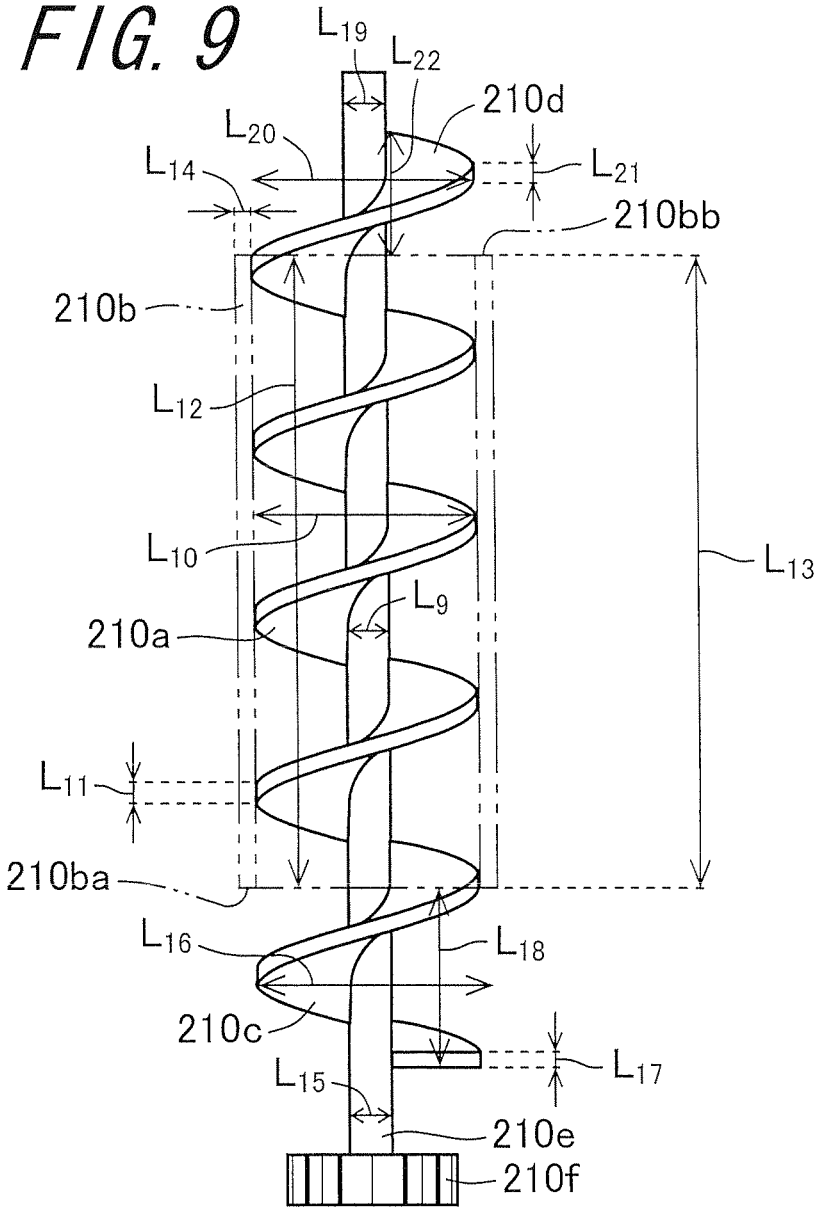
FIG. 9 is a schematic view illustrating an inside of a rotational tube.

Hereinafter, the developer pumping conveying section 210 will be described in detail. FIG. 8 is a schematic view illustrating the entire developer pumping conveying section 210. FIG. 9 is a schematic view illustrating the inside of the rotational tube 210*b*. As described above, the developer pumping conveying section 210 includes the inner spiral blade 210*a*, the rotational tube 210*b*, the first outer spiral blade 210*c*, the second outer spiral blade 210*d*, the pumping rotation shaft member 210*e*, and the pumping gear 210*f*.

The inner spiral blade 210*a*, the rotational tube 210*b*, the first outer spiral blade 210*c*, the second outer spiral blade 210*d*, the pumping rotation shaft member 210*e*, and the pumping gear 210*f* are formed of a material such as polyethylene, polypropylene, high impact polystyrene, or ABS resin (acrylonitrile-butadiene-styrene copolymer synthetic resin). In a case where the materials of the inner spiral blade 210*a*, the rotational tube 210*b*, the first outer spiral blade 210*c*, the second outer spiral blade 210*d*, the pumping rotation shaft member 210*e*, and the pumping gear 210*f* are the same, it is preferable that the developer pumping conveying section 210 is integrally formed.

In the embodiment, the inner spiral blade 210*a* is a continuous general spiral blade. In the embodiment, the "general spiral blade" approximately refers to a blade portion of an auger screw, and more specifically, refers to a member having a predetermined thickness and having a general spiral blade surface as a main surface. The general spiral blade surface is a curved surface corresponding to a spiral which is a curve, and details thereof will be described later.

In this embodiment, a "spiral" is a consecutive space curve on a side surface of an imaginary circular column, and a space curve that advances in one direction among axial line directions of the imaginary circular column while advancing in one direction among circumferential directions of the imaginary circular column. In the case of being viewed on the one direction among the axial line directions of the imaginary circular column, the spiral advancing in a right-handed direction among circumferential directions of the imaginary circular column while advancing in the one direction among the axial line directions of the imaginary circular column is referred to as being a right-handed spiral, whereas a spiral advancing in the left-handed direction while advancing in the one direction among the axial line directions of the imaginary circular column is referred to as being a left-handed spiral.

Further, among the spirals, a spiral whose lead angle is constant in all points on the spiral is especially referred to as a "general spiral". Here, an angle formed of a tangent line of the spiral at a certain point on the spiral and a straight line that is made by projecting the tangent line to a vertical plane with respect to the axial line direction of the imaginary circular column surrounded by the spiral is a "lead angle" at the point. The lead angle is an angle that is larger than 0° and smaller than 90°.

In this embodiment, the "general spiral blade surface" is a surface formed of the trajectory of one line segment $J_1$ outside an imaginary circular column $K_1$ (hereinafter a radius is $r_1$) when the line segment $J_1$ is moved in one direction $D_1$ parallel to the axial line of the imaginary circular column $K_1$ while maintaining a length $m_1$ of the line segment $J_1$ in a radial direction of the imaginary circular column $K_1$ and an attachment angle $\alpha$ of the line segment $J_1$ along one general spiral $C_1$ (hereinafter, a lead angle is constant at $\theta_1$) on a side surface of the imaginary circular column $K_1$. Here, the "attachment angle $\alpha$" is an angle formed by the line segment $J_1$ and a half-line extending in the one direction $D_1$ from a tangent point of the line segment $J_1$ and the imaginary circular column $K_1$ on a plane including the axial line of the imaginary circular column $K_1$ and the line segment $J_1$, and is an angle that is larger than 0° and smaller than 180°.

Figure 10A:
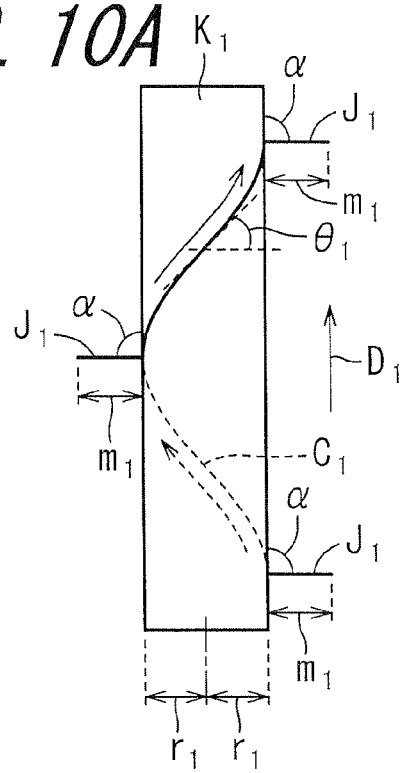
FIGS. 10A and 10B are views illustrating one cyclic general spiral blade surface.
Figure 10B:
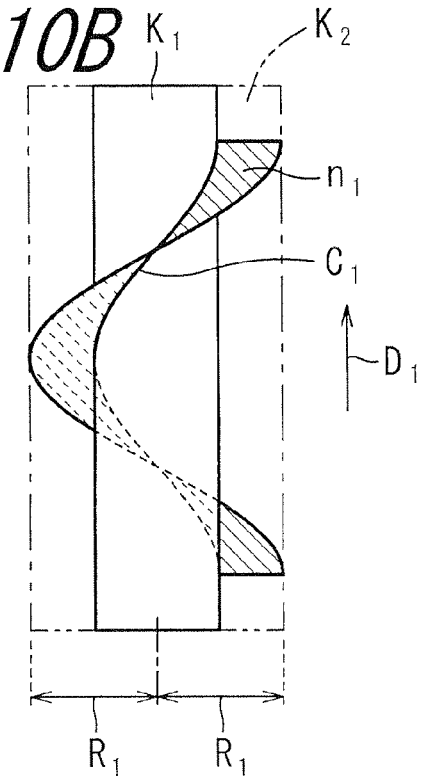

Hereinafter, as an example of the general spiral blade surface, a general spiral blade obtained when a line segment is moved along one cyclic portion of a general spiral (hereinafter, referred to as "one cyclic general spiral blade surface") is illustrated. FIGS. 10A and 10B are views illustrating one cyclic general spiral blade surface. FIG. 10A shows the side surface of the imaginary circular column $K_1$, the right-handed general spiral $C_1$ on the side surface of the imaginary circular column $K_1$, and the starting and ending positions of the line segment $J_1$ moving in one direction $D_1$ on the general spiral $C_1$. The line segment $J_1$ shown on the lowermost side of the sheet surface of FIG. 10A is the starting position of the moving line segment $J_1$, and the line segment $J_1$ shown on the uppermost side is the ending position. As shown in FIG. 10A, the trajectory of the line segment $J_1$ when the line segment $J_1$ is moved in one direction $D_1$ along the general spiral $C_1$ while constantly maintaining the length $m_1$ in the radial direction of the imaginary circular column $K_1$ and the attachment angle $\alpha$ ($\alpha$=90° in FIG. 10A) of the line segment $J_1$ corresponds to a general spiral blade surface $n_1$ shown in FIG. 10B. The surface depicted by a hatched portion in FIG. 10B is the general spiral blade surface $n_1$.

As shown in FIG. 10B, an outer circumferential portion of the general spiral blade surface $n_1$ becomes a right-handed general spiral that advances in the one direction $D_1$ on a side surface of an imaginary circular column $K_2$ whose axial line is identical with that of the imaginary circular column $K_1$. Here, the outer circumferential portion of the general spiral blade surface $n_1$ is a portion which is the most distant from the axial line of the imaginary circular column $K_1$ on the general spiral blade surface $n_1$. A radius $R_1$ of the imaginary circular column $K_2$ is equal to the sum of a radius $r_1$ of the imaginary circular column $K_1$ and the length $m_1$ of the line segment $J_1$ in the radial direction of the imaginary circular column $K_1$.

The member with such a general spiral blade surface as the main surface is the general spiral blade. In a case where the general spiral blade is used as the inner spiral blade 210*a* as in the embodiment, the general spiral blade is formed so that the general spiral blade surface $n_1$ becomes the downstream side in the conveyance direction Z, and the developer is conveyed to the downstream side in the conveyance direction Z, by the general spiral blade surface $n_1$.

Further, in a case where the general spiral blade is used as the inner spiral blade 210*a*, an internal diameter $L_9$ of the inner spiral blade 210*a* (general spiral blade) becomes a value of two times the radius $r_1$ of the imaginary circular column $K_1$ shown in FIG. 10A, and an external diameter $L_{10}$ thereof becomes a value of two times the radius $R_1$ of the imaginary circular column $K_2$ shown in FIG. 10B. Here, the internal diameter $L_9$ of the inner spiral blade 210*a* (general spiral blade) is a value of two times the distance between an inner circumferential portion of the inner spiral blade 210*a* (general spiral blade) and the axial line of the imaginary circular column $K_1$. The inner circumferential portion is a part on the inner spiral blade 210*a* (general spiral blade) in which the distance from the axial line of the imaginary circular column $K_1$ is the closest thereto in a cross section perpendicular to the axial line of the imaginary circular column $K_1$. Further, the external diameter $L_{10}$ of the inner spiral blade 210*a* (general spiral blade) is a value of two times the distance between the outer circumferential portion of the inner spiral blade 210*a* (general spiral blade) and the axial line of the imaginary circular column $K_1$. The outer circumferential portion is a part on the inner spiral blade 210*a* (general spiral blade) in which the distance from the axial line of the imaginary circular column $K_1$ is the most distant therefrom in the cross section perpendicular to the axial line of the imaginary circular column $K_1$.

The internal diameter $L_9$ of the inner spiral blade 210*a* may be appropriately set in the range of 5 mm or more and 15 mm or less, for example, and the external diameter $L_{10}$ may be appropriately set in the range of 15 mm or more and 35 mm or less, for example. Further, for example, the attachment angle $\alpha$ may not be 90°, and may be appropriately set in the range of 30° or more and 150° or less. The lead angle $\theta_1$ may be appropriately set in the range of 20° or more and 70° or less, for example. Further, a thickness $L_{11}$ of the inner spiral blade 210*a* may be appropriately set in the range of 1 mm or more and 3 mm or less, and a length $L_{12}$ of the inner spiral blade 210*a* in the longitudinal direction thereof may be appropriately set in the range of 25 mm or more and 60 mm or less.

The rotational tube 210*b* is fixed to the outer circumferential portion of the inner spiral blade 210*a* to surround the outer circumferential portion. Since the rotational tube 210*b* is fixed to the inner spiral blade 210*a*, the rotational tube 210*b* rotates with the inner spiral blade 210*a*.

The rotational tube 210*b* is a cylindrical member which extends in the conveyance direction Z. A length $L_{13}$ of the rotational tube 210*b* in the axial direction is approximately the same as the length $L_{12}$ of the inner spiral blade 210*a* in the longitudinal direction thereof. Further, a thickness $L_{14}$ of the rotational tube 210*b* is constant, and for example, may be approximately set in the range of 1 mm or more and 3 mm or less.

The rotational tube 210*b* has an inflow opening section 210*ba* which is formed in an upstream end thereof in the conveyance direction Z. Further, the rotational tube 210*b* has an outflow opening section 210*bb* which is formed in a downstream end thereof in the conveyance direction Z.

The inflow opening section 210*ba* is formed in one end of the cylindrical rotational tube 210*b* in the axial direction thereof, and is an approximately circular opening through which an internal space of the rotational tube 210*b* and an external space thereof communicate with each other. The developer which is present outside the rotational tube 210*b* in the developer tank 210 flows into the rotational tube 210*b*, through the opening of the inflow opening section 210*ba*.

The outflow opening section 210*bb* is formed in the other end of the cylindrical rotational tube 210*b* in the axial direction thereof, and is an approximately circular opening through which the internal space of the rotational tube 210*b* and the external space thereof communicate with each other. The developer which is present inside the rotational tube 210*b* flows outside the rotational tube 210*b*, through the opening of the outflow opening section 210*bb*.

The first outer spiral blade 210*c* and the second outer spiral blade 210*d* are located outside the rotational tube 210*b*. The first outer spiral blade 210*c* is continuously connected to the upstream side of the inner spiral blade 210*a* in the conveyance direction Z. The second outer spiral blade 210*d* is continuously connected to the downstream side of the inner spiral blade 210*a* in the conveyance direction Z.

The first outer spiral blade 210*c* rotates with the inner spiral blade 210*a*, and guides, by this rotation, the developer around the inflow opening section 210*ba* which is outside the rotational tube 210*b* into the inflow opening section 210*ba*.

In the embodiment, the first outer spiral blade 210*c* is a continuous general spiral blade, and the general spiral blade surface $n_1$ is formed to be the downstream side in the conveyance direction Z. An internal diameter $L_{15}$ of the first outer spiral blade 210*c* may be appropriately set in the range of 5 mm or more and 15 mm or less, for example, and an external diameter $L_{16}$ may be appropriately set in the range of 15 mm or more and 35 mm or less, for example. Further, for example, the attachment angle $\alpha$ described with reference to FIG. 10A may be appropriately set in the range of 30° or more and 150° or less. The lead angle $\theta_1$ may be appropriately set in the range of 20° or more and 70° or less, for example. Further, a thickness $L_{17}$ of the first outer spiral blade 210*c* may be appropriately set in the range of 1 mm or more and 3 mm or less, and a length $L_{18}$ of the first outer spiral blade 210*c* in the longitudinal direction thereof may be appropriately set in the range of 5 mm or more and 20 mm or less.

In the embodiment, the internal diameter $L_{15}$ of the first outer spiral blade 210*c* is equal to the internal diameter $L_9$ of the inner spiral blade 210*a*, and the external diameter $L_{16}$ of the first outer spiral blade 210*c* is equal to the external diameter $L_{10}$ of the inner spiral blade 210*a*. Accordingly, the first outer spiral blade 210*c* is smoothly connected to the inner spiral blade 210*a*.

The second outer spiral blade 210*d* rotates with the inner spiral blade 210*a*, and guides, by this rotation, the developer around the outflow opening section 210*bb* which is outside the rotational tube 210*b* to the upper conveying path P.

In the embodiment, the second outer spiral blade 210*d* is a continuous general spiral blade, and the general spiral blade surface $n_1$ is formed to be the downstream side in the conveyance direction Z. An internal diameter $L_{19}$ of the second outer spiral blade 210*d* may be appropriately set in the range of 5 mm or more and 15 mm or less, for example, and an external diameter $L_{20}$ may be appropriately set in the range of 15 mm or more and 35 mm or less, for example. Further, for example, the attachment angle $\alpha$ described with reference to FIG. 10A may be appropriately set in the range of 30° or more and 150° or less. The lead angle $\theta_1$ may be appropriately set in the range of 20° or more and 70° or less, for example. Further, a thickness $L_{21}$ of the second outer spiral blade 210*d* may be appropriately set in the range of 1 mm or more and 3 mm or less, and a thickness $L_{22}$ of the second outer spiral blade 210*d* in the longitudinal direction thereof may be appropriately set in the range of 5 mm or more and 20 mm or less.

In the embodiment, the internal diameter $L_{19}$ of the second outer spiral blade 210*d* is equal to the internal diameter $L_9$ of the inner spiral blade 210*a*, and the external diameter $L_{20}$ of the second outer spiral blade 210*d* is equal to the external diameter $L_{10}$ of the inner spiral blade 210*a*. Accordingly, the second outer spiral blade 210*d* is smoothly connected to the inner spiral blade 210*a*.

According to the developing device 200 which includes the developer pumping conveying section 210 having such a configuration, the developer which is present in the vertically lower part of the main pumping conveying path section $S_1$ flows into the rotational tube 210*b* through the inflow opening section 210*ba* formed in the vertically lower part of the rotational tube 210*b*. Then, the developer is conveyed upward in the vertical direction by the inner spiral blade 210*a* inside the rotational tube 210*b*, and flows outside the rotational tube 210*b* through the outflow opening section 210*bb* formed in the vertically upper part of the rotational tube 210*b* in the vertical direction. At this time, the rotational tube 210*b* rotates with the inner spiral blade 210*a*. Friction arises between the developer conveyed by the inner spiral blade 210*a* and an inner wall of the rotation wall 210*b* by this rotation, to thereby charge the developer.

Further, when the developer in the rotational tube 210*b* is conveyed upward in the vertical direction by the inner spiral blade 210*a*, the developer is attracted toward the attracting magnet 209 in the horizontal direction, in the rotational tube 210*b*, in the vicinity of the attracting magnet 209. The attracted developer is conveyed upward in the vertical direction while pressing the inner wall of the rotational tube 210*b*. Accordingly, in a position where magnetic force due to the attracting magnet 209 sufficiently acts on the developer, force of friction between the developer and the inner wall of the rotational tube 210*b* is increased, and thus, the developer is easily charged.

Accordingly, the developing device 200 according to the embodiment can convey the developer under sufficient charging, and can stably form a high quality image by the image forming apparatus 100. Further, the developing device 200 can rapidly and sufficiently charge even a toner which is newly supplied into the developer tank 201 from the toner cartridge 300 by the attracting magnet 209.

In a case where the developer stored in the developer tank 201 is a two-component developer including a toner and a carrier, when the two-component developer is conveyed by the inner spiral blade 210*a*, the two-component developer is agitated by the friction which arises between the two-component developer and the inner wall of the rotational tube 210*b*. Accordingly, according to the developing device 200, it is possible to sufficiently mix the toner with the carrier. Further, the developing device 200 can rapidly and sufficiently mix even a toner which is newly supplied to the developer tank 201 from the toner cartridge 300 with a carrier, by the attracting magnet 209.

Further, in the embodiment, the first outer spiral blade 210*c* is located in the vertically lower part of the inner spiral blade 210*a*, and thus, it is possible to guide the developer to the inflow opening section 210*ba* formed in the vertically lower part of the rotational tube 210*b* by the first outer spiral blade 210*c*. Thus, it is possible to suppress retention of the developer in the vertically lower part of the main pumping conveying path section $S_1$. As another embodiment, the first outer spiral blade 210*c* may not be provided. Even in a case where the first outer spiral blade 210*c* is not provided, since the developer conveyed to the pumping main conveying path section $S_1$ is forced up by the developer conveyed from the lower conveying path Q, the developer can flow into the rotational tube 210*b*.

Further, in the embodiment, the second outer spiral blade 210*d* is located in the vertically upper part of the inner spiral blade 210*a*, and thus, it is possible to guide the developer to the upper conveying path P by the second outer spiral blade 210*d*. Thus, it is possible to suppress intrusion of the developer into a gap between the rotational tube 210*b* and the inner wall of the developer tank 201, and to reliably move the developer to the upper conveying path P. As another embodiment, the second outer spiral blade 210*d* may not be provided. Even in a case where the second outer spiral blade 210*d* is not provided, at least a part of the developer which flows out of the rotational tube 210*b* can move to the upper conveying path P.

Further, in the embodiment, the vertically lower part of the main pumping conveying path section $S_1$ is formed vertically below the vertically lower part of the lower conveying path Q. Thus, compared with a case where the vertically lower part of the main pumping conveying path section $S_1$ is formed vertically above the vertically lower part of the lower conveying path Q, it is possible to smoothly move the developer to the main pumping conveying path section $S_1$. As another embodiment, the vertically lower part of the main pumping conveying path section $S_1$ may not be formed vertically below the vertically lower part of the lower conveying path Q.

Further, in the embodiment, the vertically upper part of the rotational tube 210*b* is located vertically above the vertically lower part of the upper conveying path P. Thus, compared with a case where the vertically upper part of the rotational tube 210*b* is located vertically below the vertically lower part of the upper conveying path P, it is possible to smoothly move the developer to the upper conveying path P. As another embodiment, the vertically upper part of the rotational tube 210*b* may not be formed vertically above the vertically lower part of the upper conveying path P.

Further, in the embodiment, the pumping conveying path S is divided into the main pumping conveying path section $S_1$ and the developer supply path $S_2$ by the vertical partition wall 207*b*. Further, the developer supply path $S_2$ communicates with the opening formed in the supply port section 205*a* for supply of the developer and also communicates with the vertically lower part of the main pumping conveying path section $S_1$ in which the developer pumping conveying section 210 is located. Accordingly, a new developer supplied through the supply port section 205*a* is quickly introduced to the inflow opening section 210*ba* which is formed in the vertically lower part of the rotational tube 210*b*. Thus, the developing device 200 can quickly mix the developer which is already stored in the developer tank 201 with the newly supplied developer.

Next, a developing device according to another embodiment, which is different from the developing device 200, will be described. Since the developing device has the same configuration as in the developing device 200 except that a developer pumping conveying section 220 is provided instead of the developer pumping conveying section 210, description about members other than the developer pumping conveying section 220 will be omitted.

Figure 11:
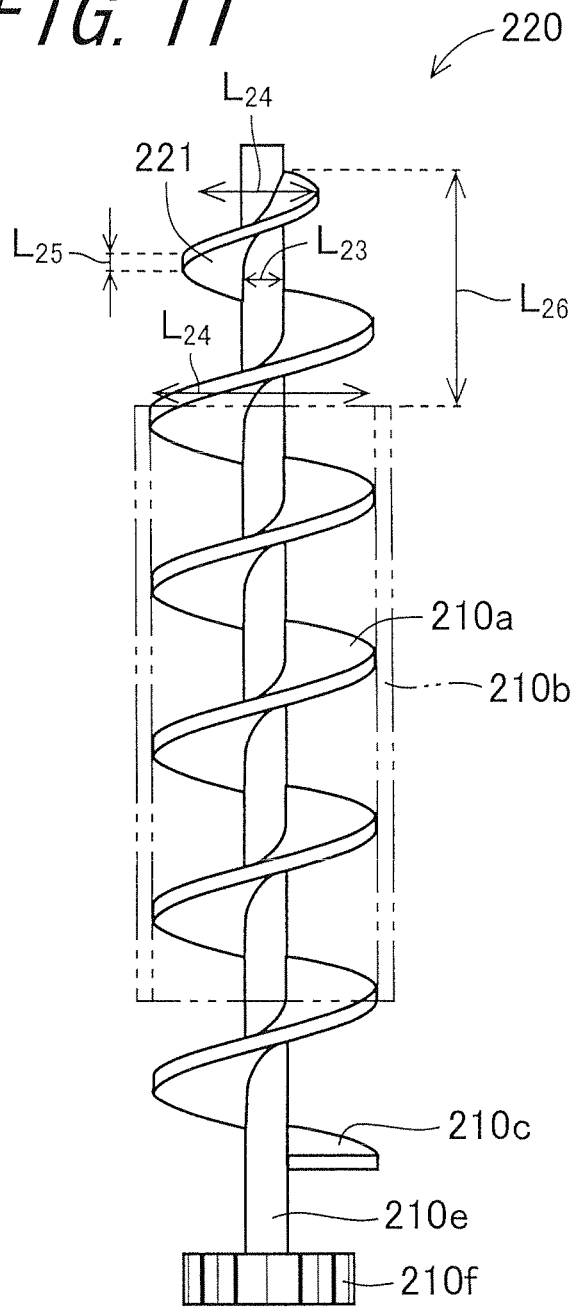
FIG. 11 is a schematic view illustrating a developer pumping conveying section.

FIG. 11 is a schematic view illustrating the developer pumping conveying section 220. The developer pumping conveying section 220 includes the inner spiral blade 210*a*, the rotational tube 210*b*, the first outer spiral blade 210*c*, a cone-shaped outer spiral blade 221, the pumping rotation shaft member 210*e*, and the pumping gear 210*f*. Description about the inner spiral blade 210*a*, the rotational tube 210*b*, the first outer spiral blade 210*c*, the pumping rotation shaft member 210*e* and the pumping gear 210*f* will be omitted.

The cone-shaped outer spiral blade 221 is continuously connected to the downstream side of the inner spiral blade 210*a* in the conveyance direction Z, rotates with the inner spiral blade 210*a*, and guides, by this rotation, the developer around the outflow opening section 210*bb*, which is present outside the rotational tube 210*b*, to the upper conveying path P. The cone-shaped outer spiral blade 221 has a shape which has a constant internal diameter and an external diameter which becomes small as it advances on the upstream side thereof in the conveyance direction Z.

In the embodiment, the cone-shaped outer spiral blade 221 is a continuous cone-shaped general spiral blade. In this embodiment, the "cone-shaped general spiral blade" is schematically a member in a shape in which an external diameter is continuously changed while maintaining an internal diameter constant in a general spiral blade. More specifically, the cone-shaped general spiral blade is a member with a predetermined thickness having a cone-shaped general spiral blade surface as described below as a main surface.

In this embodiment, the "cone-shaped general spiral blade surface" is a surface formed by the trajectory of one line segment $J_2$ outside an imaginary circular column $K_3$ (hereinafter, a radius is $r_2$) when the line segment $J_2$ is moved in one direction $D_2$ parallel to an axial line of the imaginary circular column $K_3$ while changing so that a length $m_3$ of the line segment $J_2$ in a radial direction of the imaginary circular column $K_3$ continuously becomes smaller and maintaining an attachment angle β of the line segment $J_2$ along one general spiral $C_2$ (a lead angle is $\theta_2$) on a side surface of the imaginary circular column $K_3$. Here, the "attachment angle β" is an angle formed by the line segment $J_2$ and a half-line extending in the one direction $D_2$ from a tangent point of the line segment $J_2$ and the imaginary circular column $K_3$ on a plane including the axial line of the imaginary circular column $K_3$ and the line segment $J_2$, and is an angle that is larger than 0° and smaller than 180°.

Figure 12A:
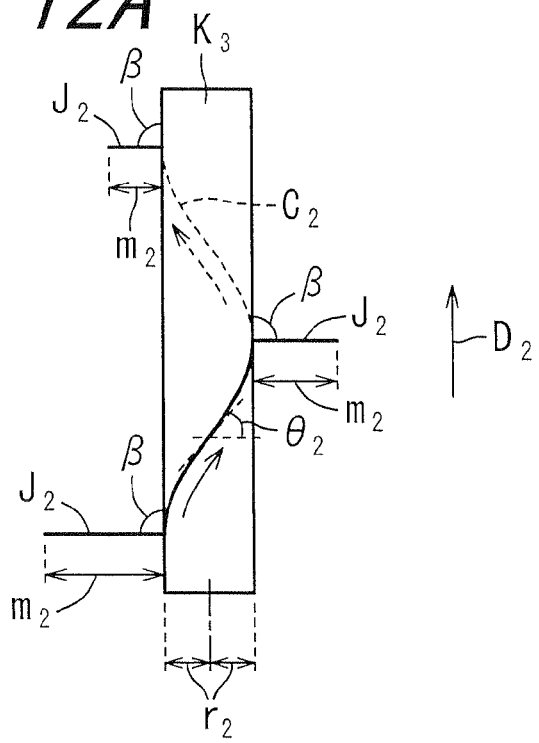
FIGS. 12A to 12D are views illustrating one cyclic cone-shaped general spiral blade surface.

Hereinafter, as an example of the cone-shaped general spiral blade surface, a cone-shaped general spiral blade surface obtained when a line segment is moved along one cyclic portion of a general spiral (hereinafter, referred to as "one cyclic cone-shaped general spiral blade surface") is illustrated. FIGS. 12A to 12D are views illustrating the one cyclic cone-shaped general spiral blade surface. FIG. 12A shows a side surface of the imaginary circular column $K_3$, a right-handed general spiral $C_2$ on the side surface of the imaginary circular column $K_3$, and starting and end positions of the line segment $J_2$ moving in the one direction $D_2$ on the general spiral $C_2$. The line segment $J_2$ shown on the lowermost side of the sheet of FIG. 12A indicates the starting position in moving, and the line segment $J_2$ shown on the uppermost side indicates the end position. As shown in FIG. 12A, the trajectory of the line segment $J_2$ when the line segment $J_2$ is moved in the one direction $D_2$ along the general spiral $C_2$ while changing so that a length $m_3$ of the line segment $J_2$ in a radial direction of the imaginary circular column $K_3$ continuously becomes smaller and constantly maintaining the attachment angle β (β=90° in FIG. 12A) of the line segment $J_2$ corresponds to a cone-shaped general spiral blade surface.

Figure 12B:
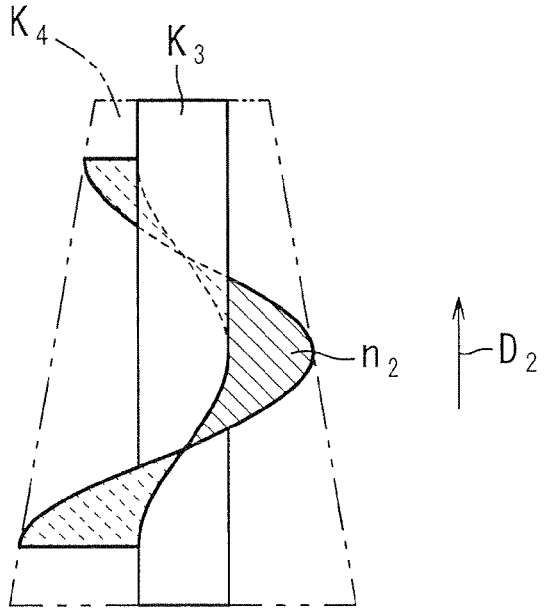
Figure 12C:
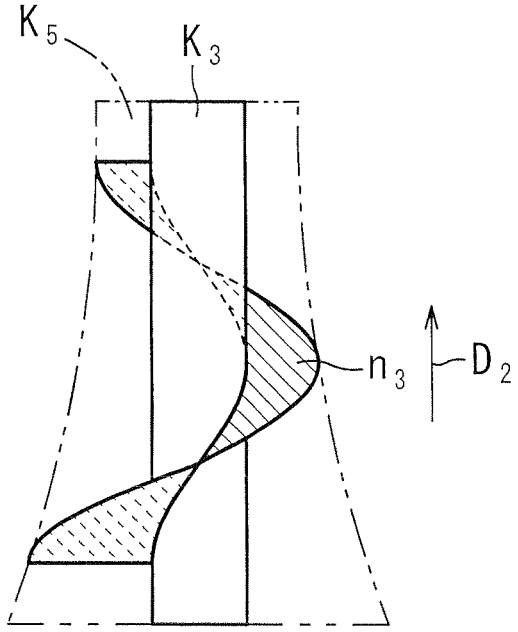
Figure 12D:
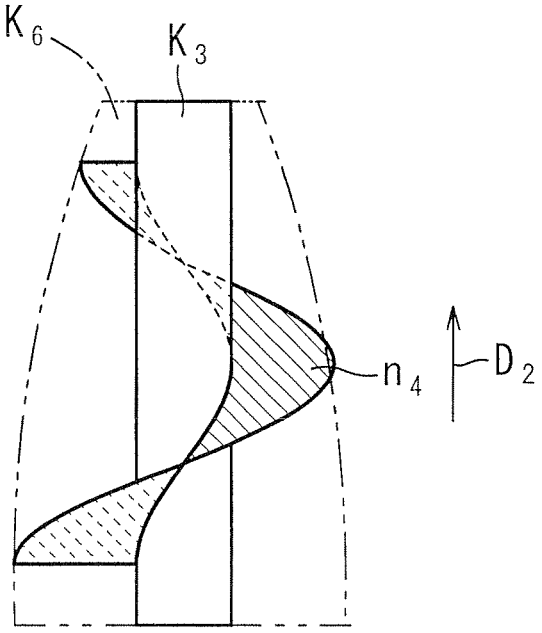

As shown in FIGS. 12B to 12D, an outer circumferential portion of the cone-shaped general spiral blade surface inscribes the side surface of an imaginary truncated cone having the same axial line as the imaginary circular column $K_3$. In this embodiment, the "truncated cone" as used herein is a solid having two bottom surfaces whose areas are different from each other, whose axial line runs through the two bottom surfaces, and whose external diameter continuously becomes smaller as advancing in one direction of the axial line directions thereof. The shape of the imaginary truncated cone inscribed by the cone-shaped general spiral blade surface differs depending on the way that the length $m_3$ of the line segment $J_2$ changes. Further, in the embodiment, the outer circumferential portion of the cone-shaped general spiral blade surface is a portion which is the most distant from the axial line of the imaginary truncated cone on the general spiral blade surface.

FIG. 12B shows a cone-shaped general spiral blade surface $n_2$ inscribing an imaginary right circular truncated cone $K_4$. In this embodiment, the "right circular truncated cone" is a solid which is not a circular cone among two solids obtained by dividing a right circular cone on one plane parallel to the bottom surface. The trajectory of the line segment $J_2$ when the rate of change of the length $m_2$ of the line segment $J_2$ per unit moving distance along the general spiral $C_2$ is constant, corresponds to the cone-shaped general spiral blade surface $n_2$ depicted by the hatched portion in FIG. 12B, and the outer circumferential portion thereof inscribes the side surface of the imaginary right circular truncated cone $K_4$.

FIG. 12C shows a cone-shaped general spiral blade surface $n_3$ inscribing an imaginary compressed right circular truncated cone $K_5$. In this embodiment, the "compressed right circular truncated cone" is a solid having such a shape that the side surface of a right circular truncated cone is curved in a direction towards the axial line. The trajectory of the line segment $J_2$ when the rate of change of the length $m_3$ of the line segment $J_2$ per unit moving distance along the general spiral $C_2$ becomes gradually smaller as advancing in one direction $D_2$, corresponds to the cone-shaped general spiral blade surface $n_3$ depicted by the hatched portion in FIG. 12C, and the outer circumferential portion thereof inscribes the side surface of the imaginary compressed right circular truncated cone $K_5$.

FIG. 12D shows a cone-shaped general spiral blade surface $n_4$ inscribing an imaginary expanded right circular truncated cone $K_6$. In this embodiment, the "expanded right circular truncated cone" is a solid having such a shape that the side surface of a right circular truncated cone is curved in a direction away from the axial line. The trajectory of the line segment $J_2$ when the rate of change of the length $m_3$ of the line segment $J_2$ per unit moving distance along the general spiral $C_2$ becomes gradually larger as advancing in one direction $D_2$, corresponds to the cone-shaped general spiral blade surface $n_4$ depicted by the hatched portion in FIG. 12D, and the outer circumferential portion thereof inscribes the side surface of the imaginary expanded right circular truncated cone $K_6$.

The member with such a cone-shaped general spiral blade surface as the main surface is the cone-shaped general spiral blade. In a case where the cone-shaped general spiral blade is used as the cone-shaped outer spiral blade 221 as in the embodiment, the cone-shaped general spiral blade is provided so that the cone-shaped general spiral blade surfaces $n_2$, $n_3$ and $n_4$ are located on the downstream side in the conveyance direction Z. The developer is conveyed to the downstream side in the conveyance direction Z by the cone-shaped general spiral blade surfaces $n_2$, $n_3$ and $n_4$.

Further, in a case where the cone-shaped general spiral blade is used as the cone-shaped outer spiral blade 221, an internal diameter $L_{23}$ of the cone-shaped outer spiral blade 221 (the cone-shaped general spiral blade) becomes a value of two times the radius $r_2$ of the imaginary circular column $K_3$ as shown in FIG. 12A, and an external diameter $L_{24}$ thereof is continuously changed from maximum value of $2m_2+2r_2$ to minimum value of $2m_2+2r_2$ as it advances on the downstream side in the conveyance direction Z, as shown in FIGS. 12B to 12D. Here, the internal diameter $L_{23}$ of the cone-shaped outer spiral blade 221 (cone-shaped general spiral blade) is a value of two times a distance between an inner circumferential portion of the cone-shaped outer spiral blade 221 (cone-shaped general spiral blade) and an axial line of the imaginary circular column $K_3$, and the inner circumferential portion is a part on the cone-shaped outer spiral blade 221 (cone-shaped general spiral blade) in which the distance from the axial line of the imaginary circular column $K_3$ is the closest thereto in a cross section perpendicular to the axial line of the imaginary circular column $K_3$. Further, the external diameter $L_{24}$ of the cone-shaped outer spiral blade 221 (cone-shaped general spiral blade) is a value of two times a distance between an outer circumferential portion of the cone-shaped outer spiral blade 221 (cone-shaped general spiral blade) and the axial line of the imaginary circular column $K_3$, and the outer circumferential portion is a part on the cone-shaped outer spiral blade 221 (cone-shaped general spiral blade) in which the distance from the axial line of the imaginary circular column $K_3$ is the most distant therefrom in the cross section perpendicular to the axial line of the imaginary circular column $K_3$.

The internal diameter $L_{23}$ of the cone-shaped outer spiral blade 221 may be appropriately set in the range of 5 mm or more and 15 mm or less, for example. The minimum value of the external diameter $L_{24}$ of the cone-shaped outer spiral blade 221 may be appropriately set in the range of 15 mm or more and 20 mm or less, for example, and the maximum value thereof may be appropriately set in the range of 25 mm or more and 35 mm or less, for example. Further, for example, the attachment angle $\beta$ may not be 90°, and may be appropriately set in the range of 30° or more and 150° or less. The lead angle $\theta_2$ may be appropriately set in the range of 20° or more and 70° or less, for example. Further, a thickness $L_{25}$ of the cone-shaped outer spiral blade 221 may be appropriately set in the range of 1 mm or more and 3 mm or less, and a length $L_{26}$ of the cone-shaped outer spiral blade 221 in the longitudinal direction thereof may be appropriately set in the range of 5 mm or more and 20 mm or less.

In the embodiment, the maximum value of the external diameter $L_{24}$ of the cone-shaped outer spiral blade 221 is equal to the external diameter $L_{10}$ of the inner spiral blade 210*a*, and the internal diameter $L_{14}$ of the cone-shaped outer spiral blade 221 is equal to the internal diameter $L_9$ of the inner spiral blade 210*a*. Accordingly, the cone-shaped outer spiral blade 221 is smoothly connected to the inner spiral blade 210*a*.

According to the developing device which includes such a developer pumping conveying section 220, the cone-shaped outer spiral blade 221 having the shape which has the constant internal diameter and the external diameter which is continuously decreased as it advances on the downstream side in the conveyance direction Z, is located in the vertically upper part of the inner spiral blade 210*a*, the amount of the developer conveyed by the developer pumping conveying section 220 on the downstream side in the conveyance direction Z with reference to the rotational tube 210*b* can be gradually decreased as it advances on the downstream side in the conveyance direction Z. Thus, even in a case where flowability of the developer is significantly deteriorated, it is possible to prevent the developer from being narrowed and compressed by the developer pumping conveying section 220 and the developer tank 205.

In each of the above-described embodiments, even though the permanent magnet is used as the attracting magnet 209, as an another embodiment, an electromagnet may be used instead of the permanent magnet. Hereinafter, a case where the electromagnet magnet is used as the attracting magnet 209 will be described.

The electromagnet comprises an iron core, a coil wound around the iron core, and an electric current source which applies electric current to the coil. In the case where the electromagnet is used as the attracting magnet 209, by appropriately changing the number of coil turns or a value of electric current, a magnetic field having a magnetic flux density of about 30 mT to 100 mT is generated at a point on the axial line of the rotational tube 210*b*, and thus, the developer is attracted at least in the horizontal direction by the magnetic field.

In the case where the electromagnet is used as the attracting magnet 209, since it is possible to change the intensity of the generated magnetic field depending on the circumstances unlike the permanent magnet, it is possible to efficiently charge the developer. For example, in a case where the toner is supplied to the developer tank 201 from the toner cartridge 300, a strong magnetic field is generated when the supply amount of the toner is large, and a weak magnetic field is generated when the supply amount of the toner is small. That is, it is possible to adjust the magnetic field according to the supply amount of the toner.

Further, in the case where the electromagnet is used as the attracting magnet 209, it is also possible to adjust the intensity of the generated magnetic field depending on time. For example, according to the developing device 200 which uses the electromagnet as the attracting magnet 209, in a period between a time point when the developer is supplied from the outside of the developer tank 201 into the developer tank 201 and a time point when a predetermined time has elapsed therefrom, compared with a different period, the value of electric current which is applied to the coil of the attracting magnet 209 (electromagnet) is increased to operate the attracting magnet 209 (electromagnet) so that a maximum value of the total magnetic flux, in the rotational tube 210*b*, of the magnetic field generated by the attracting magnet 209 (electromagnet) is increased so as to attract the developer, and the developer is conveyed by the inner spiral blade 210*a*, and thus, it is possible to convey the developer while agitating the developer. In the embodiment, the predetermined time is about 30 seconds. In a specific period, in a case where the total magnetic flux in the rotational tube 210*b* is constant, the constant value is considered as the maximum value.

In this way, in the period between the time point when the developer is supplied into the developer tank 201 and the time point when the predetermined time has elapsed therefrom, by operating the attracting magnet 209 (electromagnet) so that the maximum value of the total magnetic flux in the rotational tube 210*b* of the magnetic field generated by the attracting magnet 209 (electromagnet) is increased, when a new developer is supplied, it is possible to rapidly charge the developer by the attracting magnet 209 (electromagnet), and when the new developer is not supplied, it is possible to suppress stress generated in the developer.

In a case where the attracting magnet 209 (electromagnet) is operated, the attracting magnet 209 (electromagnet) may be continuously operated in the period, but it is preferable that the attracting magnet 209 (electromagnet) is intermittently operated. Since, by intermittently operating the attracting magnet 209 (electromagnet), the horizontal movement of the developer due to the attracting magnet 209 (electromagnet) is actively performed in the rotational tube 210*b*, it is possible to reliably charge the developer. In a case where the attracting magnet 209 (electromagnet) is intermittently operated, square wave current or sine wave current having a frequency of about 0.2 Hz to about 1 Hz may be applied to the coil of the attracting magnet 209 (electromagnet).

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developing device for storing a developer containing a ferromagnetic substance and supplying the developer to an image bearing member to develop an electrostatic latent image formed on the image bearing member, comprising:

a developer tank which stores therein the developer;

a partition wall which divides an internal space of the developer tank into:

an upper conveying path which is located along a longitudinal direction of the partition wall and extends in a substantially horizontal direction, a lower conveying path which extends in the substantially horizontal direction on a vertically lower side of the upper conveying path with the partition wall interposed therebetween, a communication path through which the upper conveying path communicates with the lower conveying path on one end side of the partition wall in the longitudinal direction thereof, and a pumping conveying path through which the upper conveying path communicates with the lower conveying path on another end side of the partition wall in the longitudinal direction thereof and extends in the substantially vertical direction;

an upper developer conveying section which is located in the upper conveying path and conveys the developer in the developer tank in the substantially horizontal direction, the upper developer conveying section conveying the developer toward the other end side of the partition wall in the longitudinal direction thereof from the one end side of the partition wall in the longitudinal direction thereof;

a lower developer conveying section which is located in the lower conveying path and conveys the developer in the developer tank in the substantially horizontal direction, the lower developer conveying section conveying the developer toward the one end side of the partition wall in the longitudinal direction thereof from the other end side of the partition wall in the longitudinal direction thereof;

a developer pumping conveying section which is located in the pumping conveying path and conveys the developer in the developer tank upward in a substantially vertical direction, the developer pumping conveying section comprising:

an inner spiral blade having a shape spirally wound around a side surface of an imaginary circular column, the inner spiral blade conveying the developer upward in the substantially vertical direction by a rotational movement around an axial line of the imaginary circular column, and a rotational tube having both ends which are opened in the vertical direction, the rotational tube surrounding an outer circumferential portion of the inner spiral blade, and rotating with the inner spiral blade; and an attracting magnet located in a position spaced from the rotational tube in the horizontal direction, the attracting magnet attracting the developer in the developer tank at least in the horizontal direction.

2. The developing device of claim 1, wherein the attracting magnet is an electromagnet.

3. An electrophotographic image forming apparatus comprising the developing device of claim 1.

* * * * *